US011786906B2

(12) United States Patent
Jones et al.

(10) Patent No.: US 11,786,906 B2
(45) Date of Patent: Oct. 17, 2023

(54) RESISTIVE HEATERS AND ANISOTROPIC THERMAL TRANSFER

(71) Applicant: BIOFIRE DEFENSE, LLC, Salt Lake City, UT (US)

(72) Inventors: David E. Jones, Layton, UT (US); Michael Bills, Salt Lake City, UT (US); Aaron D. Wernerehl, Salt Lake City, UT (US); Anson Cole Chamberlain, American Fork, UT (US)

(73) Assignee: Biofire Defense, LLC, Salt Lake City, UT (US)

( * ) Notice: Subject to any disclaimer, the term of this patent is extended or adjusted under 35 U.S.C. 154(b) by 1195 days.

(21) Appl. No.: 16/093,124

(22) PCT Filed: Apr. 14, 2017

(86) PCT No.: PCT/US2017/027753
§ 371 (c)(1),
(2) Date: Oct. 11, 2018

(87) PCT Pub. No.: WO2017/181100
PCT Pub. Date: Oct. 19, 2017

(65) Prior Publication Data

US 2021/0213454 A1 Jul. 15, 2021

Related U.S. Application Data

(63) and a continuation-in-part of application No. 15/099,721, filed on Apr. 15, 2016, now abandoned.

(60) Provisional application No. 62/357,525, filed on Jul. 1, 2016.

(51) Int. Cl.
*B01L 7/00* (2006.01)
*B01L 3/00* (2006.01)

(52) U.S. Cl.
CPC ..... *B01L 7/52* (2013.01); *B01L 3/5027* (2013.01); *B01L 2200/16* (2013.01); *B01L 2300/1822* (2013.01); *B01L 2300/1827* (2013.01)

(58) Field of Classification Search
CPC ..... B01L 7/52; B01L 3/5027; B01L 2200/16; B01L 2300/1822; B01L 2300/1827
See application file for complete search history.

(56) References Cited

U.S. PATENT DOCUMENTS

| | | | | |
|---|---|---|---|---|
| 2,481,554 | A | 9/1949 | Winstead | |
| 2,944,138 | A | 7/1960 | Goff | |
| 5,542,471 | A | 8/1996 | Dickinson | |
| 5,601,141 | A | 2/1997 | Gordon et al. | |
| 6,337,435 | B1 * | 1/2002 | Chu | B01L 7/52 136/203 |
| 6,432,695 | B1 | 8/2002 | Zou et al. | |
| 6,645,758 | B1 | 11/2003 | Schnipelsky et al. | |
| 6,767,512 | B1 * | 7/2004 | Lurz | B01L 3/50853 436/155 |
| 6,780,617 | B2 | 8/2004 | Chen | |
| 7,387,887 | B2 | 6/2008 | Wittwer et al. | |
| 7,618,811 | B2 * | 11/2009 | Juncosa | B01L 3/5027 435/287.2 |
| 8,394,608 | B2 | 3/2013 | Ririe et al. | |
| 8,895,295 | B2 | 11/2014 | Ririe et al. | |
| 2001/0003335 | A1 | 6/2001 | Griffiths et al. | |
| 2006/0288708 | A1 | 12/2006 | Maltezos et al. | |
| 2007/0173589 | A1 | 7/2007 | Chibante | |
| 2008/0274511 | A1 * | 11/2008 | Tan | B01L 7/52 435/91.2 |
| 2010/0081191 | A1 * | 4/2010 | Woods | B01L 7/52 435/303.1 |

(Continued)

FOREIGN PATENT DOCUMENTS

| | | |
|---|---|---|
| GB | 1384235 | 2/1975 |
| JP | 2000040579 | 2/2000 |

(Continued)

OTHER PUBLICATIONS

Uetani et al. Elastomeric Thermal Interface Materials with High Through-Plane Thermal Conductivity from Carbon Fiber Fillers Vertically Aligned by Electrostatic Flocking. 2014, Advanced Materials, 26, 33 p. 5857-5862 (Year: 2014).*

U.S. Appl. No. 15/099,721, Aug. 21, 2019, Final Office Action.

Okuda, Katsuhiko, "English-machine translation of JP 2007-027035 A" (Year: 2007).

Shirouchi et al. "English-machine translation of JP 2000-040579 A". (Year: 2000).

United States International Search Authority, International Search Report and Written Opinion, PCT/US2017/027753, dated Aug. 19, 2017.

(Continued)

*Primary Examiner* — Samuel C Woolwine
*Assistant Examiner* — Carolyn L Greene
(74) *Attorney, Agent, or Firm* — WORKMAN NYDEGGER

(57) ABSTRACT

System, heaters, and heat transfer devices are disclosed. For example, a system for performing polymerase chain reaction includes a support member configured to receive a sample vessel and a heater that is positioned to affect a temperature of the sample vessel. The system additionally includes a heat transfer device disposed between the heater and the sample vessel. The heat transfer device illustratively includes anisotropic fibers axially aligned parallel to one another and positioned to conduct heat from the at least one heater toward the sample vessel in the axial direction of the anisotropic fibers. An exemplary heater includes a body defining one or more channels, a heating element positioned in the one or more channels, and retention members adjacent the one or more channels. At least a portion of the heating element is mechanically interlocked with the channel by deforming the retention members into a closed position.

14 Claims, 20 Drawing Sheets

(56) References Cited

U.S. PATENT DOCUMENTS

| | | | | |
|---|---|---|---|---|
| 2013/0137594 | A1* | 5/2013 | Bertrand | G01N 35/1011 506/9 |
| 2014/0038272 | A1 | 2/2014 | Ririe | |
| 2014/0220579 | A1 | 8/2014 | De Vos | |
| 2014/0283945 | A1 | 9/2014 | Jones et al. | |
| 2015/0118715 | A1 | 4/2015 | Wittwer et al. | |
| 2016/0332164 | A1* | 11/2016 | Thomsen | C12Q 1/686 |
| 2017/0297028 | A1 | 10/2017 | Jones et al. | |

FOREIGN PATENT DOCUMENTS

| | | | | |
|---|---|---|---|---|
| JP | 2007027035 | | 2/2007 | |
| WO | WO-1989012502 | A1 * | 12/1989 | B01L 7/00 |

OTHER PUBLICATIONS

International Search Report and Written Opinion for PCT/US2017/027753 dated Aug. 29, 2017.
U.S. Appl. No. 15/099,721, Oct. 18, 2018, Office Action.

* cited by examiner

RESISTIVE HEATERS AND ANISOTROPIC THERMAL TRANSFER

CROSS-REFERENCE TO RELATED APPLICATIONS

This application claims priority to PCT Application No. PCT/US2017/027753, filed Apr. 14, 2017, entitled "Resistive Heaters and Anisotropic Thermal Transfer", which claims the benefit of and priority to U.S. Provisional Application No. 62/357,525 filed Jul. 1, 2016, entitled "Anisotropic Thermal Transfer Device". PCT Application No. PCT/US2017/027753, filed Apr. 14, 2017, also claims priority to U.S. patent application Ser. No. 15/099,721 filed Apr. 15, 2016, entitled "Rapid Response Resistive Heater". All the aforementioned applications are incorporated by reference herein in their entirety.

GOVERNMENT LICENSE RIGHTS

This invention was made with government support under W911QY-13-D-0080 awarded by the U.S. Department of Defense. The government has certain rights in the invention.

BACKGROUND OF THE DISCLOSURE

In the United States, Canada, and Western Europe infectious disease accounts for approximately 7% of human mortality, while in developing regions infectious disease accounts for over 40% of human mortality. Infectious diseases lead to a variety of clinical manifestations. Among common overt manifestations are fever, pneumonia, meningitis, diarrhea, and hemorrhagic diarrhea. While the physical manifestations may implicate some pathogens—or eliminate others—as the etiologic agent, it often cannot definitively identify the pathogen, and a clear diagnosis often requires a variety of assays be performed. Traditional microbiology techniques for diagnosing pathogens can take days or weeks, often delaying a proper course of treatment.

In recent years, the polymerase chain reaction (PCR) has become a method of choice for rapid diagnosis of infectious agents. PCR can be a rapid, sensitive, and specific tool to diagnose infectious disease. A challenge to using PCR as a primary means of diagnosis is the variety of possible pathogens and the low levels of target nucleic acid present in some specimens. It is often impractical to run large panels of PCR assays, one for each possible pathogen, as an overwhelming majority of candidates are expected to return a negative result—a costly and time consuming process. The problem is exacerbated when the target nucleic acid is at a low concentration and requires a large volume of sample to gather adequate reaction templates.

In some cases there is inadequate sample to assay for all possible etiologic agents. A solution is to run "multiplex PCR" wherein the sample is concurrently assayed for multiple targets in a single reaction. While multiplex PCR has proved to be valuable in some systems, shortcomings exist concerning robustness of high level multiplex reactions and difficulties for clear analysis of multiple products. To solve these problems, the assay may be subsequently divided into multiple secondary PCRs. Nesting secondary reactions within the primary product can increase robustness. Closed systems, such as the FilmArray® (BioFire Diagnostics, LLC, Salt Lake City, Utah), reduce handling and can thereby diminish contamination risk.

PCR includes the heating of a sample through one or more heating profiles. The sample is placed in proximity to or in contact with a heater, and the heater is then cycled through the desired temperature profiles to heat, decompose, volatize, or otherwise change the state of the sample. The thermal response of the heater controls the state of the sample during the PCR, and therefore, precise temperature control and rapid changes in the temperature of the heater are desirable.

Electric heaters can generate thermal energy by applying a current through a resistive material. For example, the temperature of an electrically conductive wire increases as the current flowing through the wire increases. A heat spreader can be used to control the transmission of the thermal energy from the wire to the sample. The heat spreader can also aid in maintaining uniformity of the thermal energy over the contact surface area with the sample. Efficient thermal transmission between the heating element and the heat spreader is desirable.

Making consistent contact with the surface area of the sample can ensure efficient heat transfer from the heater to the sample. However, too much interaction between the heater and the sample may not be desirable. Too much interaction with the heater can cause the sample fluids to be pushed out of the sample vessel, potentially causing unwanted mixing and contamination of the sample. Thus, an efficient heat transfer mechanism that does not disturb the sample is desirable.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In an embodiment, a system for performing polymerase chain reaction (PCR) comprises a support member configured to receive a sample vessel having a sample therein, at least one heater associated with the support member and positioned to affect a temperature of the sample vessel, and a heat transfer device disposed between the at least one heater and the sample vessel. The heat transfer device comprises anisotropic fibers axially aligned parallel to one another and positioned to conduct heat from the at least one heater toward the sample vessel in the axial direction of the anisotropic fibers.

In another embodiment, a heater comprises a body defining one or more channels, a heating element positioned in the one or more channels, and one or more retention members adjacent the one or more channels. At least a portion of the heating element is mechanically interlocked with the channel by the one or more retention members. In some embodiments, the one or more retention members are deformable between an open position and a closed position such that at least a portion of the heating element is mechanically interlocked with the channel when the one or more retention members are in the closed position. Additionally, or alternatively, the one or more channels surround at least 50% of the resistive heating element, as defined by a transverse cross-section of the heater. Alternatively, the one or more channels may surround an area that is less than 50% of the resistive heating element, illustratively 30%, as defined by a transverse cross-section of the heater.

In yet another embodiment, a heat transfer device comprises a plurality of anisotropic fibers axially aligned parallel to one another and normal or essentially normal to one or more of a target (e.g., a sample vessel) and/or heater and which is configured to conduct heat from the heater to the target in an axial direction of the anisotropic fibers and a retaining mechanism configured to hold the anisotropic fibers together. In an embodiment, the anisotropic fibers comprise carbon or graphite fibers. In some embodiments, the heat transfer device has a thermal conductivity in the axial direction between about $$200-6600\ \frac{W}{m\cdot K},$$

between about $$300-1200\ \frac{W}{m\cdot K},$$

between about $$300-900\ \frac{W}{m\cdot K},$$

or between about $$900-1200\ \frac{W}{m\cdot K}.$$

Additionally, or alternatively, the anisotropic fibers have a specific heat capacity below $$0.9\ \frac{\mathrm{J}}{g\cdot{}^{\circ}\mathrm{C.}},$$

preferably between about $$0.6-0.8\ \frac{\mathrm{J}}{\mathrm{g}\cdot{}^{\circ}\mathrm{C.}},$$

and more preferably between about $$0.7-0.75\ \frac{\mathrm{J}}{\mathrm{g}\cdot{}^{\circ}\mathrm{C.}}.$$

In some embodiments, the anisotropic fibers can be additionally characterized in that each fiber has a thermal conductivity of less than in $$1\ \frac{\mathrm{W}}{\mathrm{m}\cdot\mathrm{K}}$$

in the radial affection or the fiber, preferably less than $$0.8\ \frac{\mathrm{W}}{\mathrm{m}\cdot\mathrm{K}}.$$

In yet another embodiment, a method of manufacturing a heater includes providing a body having a channel therein; insulating the body from a heating element by an electrically insulating layer; inserting the heating element into the channel; and deforming at least a portion of the heater to mechanically secure the heating element in the channel. In at least one embodiment, a retention member of the body is plastically deformed to retain the heating element in the channel.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
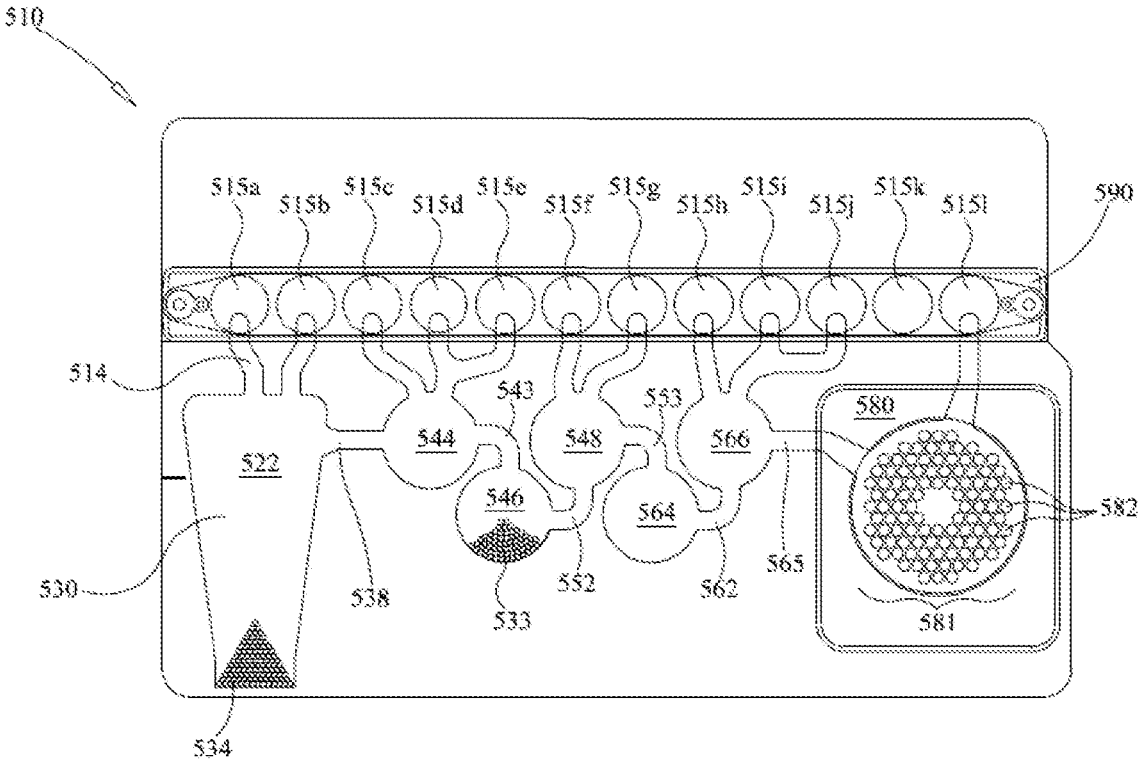
FIG. 1 shows a flexible pouch useful for self-contained PCR.

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

Unless defined otherwise, all terms (including technical and scientific terms) used herein have the same meaning as commonly understood by one of ordinary skill in the art to which the present disclosure pertains. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. The terminology used in the description of the invention herein is for the purpose of describing particular embodiments only and is not intended to be limiting of the invention. While a number of methods and materials similar or equivalent to those described herein can be used in the practice of the present disclosure, only certain exemplary materials and methods are described herein.

All publications, patent applications, patents or other references mentioned herein are incorporated by reference in their entirety. In case of a conflict in terminology, the present specification is controlling.

Various aspects of the present disclosure, including devices, systems, methods, etc., may be illustrated with reference to one or more exemplary implementations. As used herein, the terms "exemplary" and "illustrative" mean "serving as an example, instance, or illustration," and should not necessarily be construed as preferred or advantageous over other implementations disclosed herein. In addition, reference to an "implementation" or "embodiment" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an," and "the" include plural referents unless the content clearly dictates otherwise. Thus, for example, reference to "a tile" includes one, two, or more tiles. Similarly, reference to a plurality of referents should be interpreted as comprising a single referent and/or a plurality of referents unless the content and/or context clearly dictate otherwise. Thus, reference to "tiles" does not necessarily require a plurality of such tiles. Instead, it will be appreciated that independent of conjugation; one or more tiles are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

As used herein, directional and/or arbitrary terms, such as "top," "bottom," "left," "right," "up," "down," "upper," "lower," "inner," "outer," "internal," "external," "interior," "exterior," "proximal," "distal," "forward," "reverse," and the like can be used solely to indicate relative directions and/or orientations and may not be otherwise intended to limit the scope of the disclosure, including the specification, invention, and/or claims.

It will be understood that when an element is referred to as being "coupled," "connected," or "responsive" to, or "on," another element, it can be directly coupled, connected, or responsive to, or on, the other element, or intervening elements may also be present. In contrast, when an element is referred to as being "directly coupled," "directly connected," or "directly responsive" to, or "directly on," another element, there are no intervening elements present.

Example embodiments of the present inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the present inventive concepts should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of example embodiments.

It will be understood that although the terms "first," "second," etc. may be used herein to describe various elements, these elements should not be limited by these terms. These terms are only used to distinguish one element from another. Thus, a "first" element could be termed a "second" element without departing from the teachings of the present embodiments.

It is also understood that various implementations described herein can be utilized in combination with any other implementation described or disclosed, without departing from the scope of the present disclosure. Therefore, products, members, elements, devices, apparatus, systems, methods, processes, compositions, and/or kits according to certain implementations of the present disclosure can include, incorporate, or otherwise comprise properties, features, components, members, elements, steps, and/or the like described in other implementations (including systems, methods, apparatus, and/or the like) disclosed herein without departing from the scope of the present disclosure. Thus, reference to a specific feature in relation to one implementation should not be construed as being limited to applications only within said implementation.

The headings used herein are for organizational purposes only and are not meant to be used to limit the scope of the description or the claims. To facilitate understanding, like reference numerals have been used, where possible, to designate like elements common to the figures. Furthermore, where possible, like numbering of elements have been used in various figures. Furthermore, alternative configurations of a particular element may each include separate letters appended to the element number.

Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The word "or" as used herein means any one member of a particular list and also includes any combination of members of that list.

The term "sample" is meant to include an animal; a tissue or organ from an animal; a cell (either within a subject, taken directly from a subject, or a cell maintained in culture or from a cultured cell line); a cell lysate (or lysate fraction) or cell extract; a solution containing one or more molecules derived from a cell (prokaryotic and/or eukaryotic), cellular material, or viral material (e.g. a polypeptide or nucleic acid); or a solution containing a non-naturally occurring nucleic acid, which is assayed as described herein. A sample may also be any body fluid or excretion (for example, but not limited to, blood, urine, stool, saliva, tears, bile, or cerebrospinal fluid) that may or may not contain host or pathogen cells, cell components, or nucleic acids.

The phrase "nucleic acid" as used herein refers to a naturally occurring or synthetic oligonucleotide or polynucleotide, whether DNA or RNA or DNA-RNA hybrid, single-stranded or double-stranded, sense or antisense, which is capable of hybridization to a complementary nucleic acid by Watson-Crick base pairing. Nucleic acids of the invention can also include nucleotide analogs (e.g., BrdU), and non-phosphodiester internucleoside linkages (e.g., peptide nucleic acid (PNA) or thiodiester linkages). In particular, nucleic acids can include, without limitation, DNA, cDNA, gDNA, ssDNA, dsDNA, (+)ssRNA, (−)ssRNA, dsRNA, or any combination thereof.

As used herein, the term "probe," "primer," or "oligonucleotide" is meant to include a single-stranded nucleic acid molecule of defined sequence that can base pair to a second nucleic acid molecule that contains a complementary sequence (the "target" sequence). The stability of the resulting hybrid depends upon the length, GC content, and the extent of the base pairing that occurs. The extent of base pairing is affected by parameters such as the degree of complementarity between the probe and target molecules and the degree of stringency of the hybridization conditions. The degree of hybridization stringency is affected by parameters such as temperature, salt concentration, and the concentration of organic molecules such as formamide, and is determined by methods known to one skilled in the art. Probes, primers, and oligonucleotides may be detectably-labeled, either radioactively, fluorescently, or non-radioactively, by methods well-known to those skilled in the art. dsDNA binding dyes may be used to detect dsDNA. It is understood that a "primer" is specifically configured to be extended by a polymerase, whereas a "probe" or "oligonucleotide" may or may not be so configured.

As used herein, the term "dsDNA binding dyes" includes dyes that fluoresce differentially when bound to double-stranded DNA than when bound to single-stranded DNA or free in solution, usually by fluorescing more strongly. While reference is made to dsDNA binding dyes, it is understood that any suitable dye may be used herein, with some non-limiting illustrative dyes described in U.S. Pat. No. 7,387,887, herein incorporated by reference. Other signal producing substances may be used for detecting nucleic acid amplification and melting, illustratively enzymes, antibodies, etc., as are known in the art.

The term "specifically hybridizes" is used to describe a probe, primer, or oligonucleotide that recognizes and physically interacts (e.g., base pairs) with a substantially complementary nucleic acid (e.g., a sample nucleic acid) under high stringency conditions and does not substantially base pair with other nucleic acids.

As used herein, "high stringency conditions" typically occur at about the melting temperature (Tm) minus 5° C. (i.e. 5° below the Tm of the probe). Functionally, high stringency conditions are used to identify nucleic acid sequences having at least 80% sequence identity.

While PCR is the amplification method used in the examples herein, it is understood that any amplification method that uses a primer may be suitable. Such suitable procedures include strand displacement amplification (SDA); nucleic acid sequence-based amplification (NASBA); cascade rolling circle amplification (CRCA), loop-mediated isothermal amplification of DNA (LAMP); isothermal and chimeric primer-initiated amplification of nucleic acids (ICAN); target based-helicase dependent amplification (HDA); transcription-mediated amplification (TMA), and the like. Therefore, when the term PCR is used, it should be understood to include other alternative amplification methods. For amplification methods without discrete cycles, reaction time may be used where measurements are made in cycles or Cp, and additional reaction time may be added where additional PCR cycles are added in the embodiments described herein. It is understood that protocols may need to be adjusted accordingly.

While various examples herein reference human targets and human pathogens, these examples are illustrative only. Methods, kits, and devices described herein may be used to detect and sequence a wide variety of nucleic acid sequences from a wide variety of samples, including, human, veterinary, industrial, and environmental samples.

Various embodiments disclosed herein use a self-contained nucleic acid analysis pouch to assay a sample for the presence of various biological substances, illustratively antigens and nucleic acid sequences, illustratively in a single closed system. Such systems, including pouches and instruments for use with the pouches, are disclosed in more detail in U.S. Pat. Nos. 8,394,608; and 8,895,295; and U.S. Patent Publication No. 2014/0283945, which are herein incorporated by reference. However, it is understood that such pouches are illustrative only, and the nucleic acid preparation and amplification reactions discussed herein may be performed in any of a variety of open or closed system sample vessels, such as multi-well assay plates (e.g., 96-well plates, 384-well plates, etc.), plates of other configurations, arrays, carousels, and the like, using a variety of nucleic acid purification and amplification systems, as are known in the art. While the terms "sample well," "amplification well," "amplification container," or similar are used herein, these terms are meant to encompass wells, tubes, and various other reaction containers, as are used in these amplification systems. In one embodiment, the pouch is used to assay for multiple pathogens. The pouch may include one or more blisters used as sample wells, illustratively in a closed system. Illustratively, various steps may be performed in the optionally disposable pouch, including nucleic acid preparation, primary large volume multiplex PCR, dilution of primary amplification product, and secondary PCR, culminating with optional real-time detection or post-amplification analysis such as melting-curve analysis. Further, it is understood that while the various steps may be performed in pouches of the present invention, one or more of the steps may be omitted for certain uses, and the pouch configuration may be altered accordingly.

FIG. 1 shows an illustrative pouch 510 that can be used in various embodiments disclosed herein, or which can be reconfigured for use in various disclosed embodiments. Pouch 510 is similar to FIG. 15 of U.S. Pat. No. 8,895,295 ("the '295 patent"), with like items numbered the same. Fitment 590 is provided with entry channels 515*a* through 515*l*, which also serve as reagent reservoirs or waste reservoirs. Illustratively, reagents may be freeze dried in fitment 590 and rehydrated prior to use. Blisters 522, 544, 546, 548, 564, and 566, with their respective channels 514, 538, 543, 552, 553, 562, and 565 are similar to blisters of the same reference numbers disclosed by FIG. 15 of the '295 patent and the associated disclosure. Second-stage reaction zone 580 of FIG. 1 is similar to that of the '295 patent, but the second-stage wells 582 of high density array 581 are arranged in a somewhat different pattern. The more circular pattern of high density array 581 of FIG. 1 eliminates wells in corners and may result in more uniform filling of second-stage wells 582. As shown, the high density array 581 is provided with 102 second-stage wells 582. Pouch 510 is suitable for use in the FilmArray® instrument (BioFire Diagnostics, LLC, Salt Lake City, Utah). However, it is understood that the pouch embodiment is illustrative only.

While other containers may be used, pouch 510 is formed of two layers of a flexible plastic film or other flexible material, such as polyester, polyethylene terephthalate, polycarbonate, polypropylene, polymethylmethacrylate, and mixtures thereof that can be made by any process known in the art, including extrusion, plasma deposition, and lamination. Metal foils or plastics with aluminum lamination also may be used. Other barrier materials are known in the art that can be sealed together to form the blisters and channels. If plastic film is used, the layers can be bonded together, illustratively, by heat sealing. In some embodiments, the material has low nucleic acid binding capacity.

For embodiments employing fluorescence monitoring, plastic films that exhibit adequately low absorbance and auto-fluorescence at the operative wavelengths are preferred. Such material could be identified by testing different plastics, different plasticizers, and composite ratios, as well as different thicknesses of the film. For plastics with aluminum or other foil lamination, the portion of the pouch that is to be read by a fluorescence detection device can be left without the foil.

For example, if fluorescence is monitored in second-stage wells 582 of the second-stage reaction zone 580 of pouch 510, then one or both layers at wells 582 would be left without the foil. In the example of PCR, film laminates composed of polyester (Mylar, DuPont, Wilmington Del.) of about 0.0048 inch (0.1219 mm) thickness and polypropylene films of 0.001-0.003 inch (0.025-0.076 mm) thickness perform well. In an embodiment, pouch 510 is made of a clear or translucent material capable of transmitting approximately 80%-90% of incident light.

In the illustrative embodiment, the materials are moved between blisters by the application of pressure, illustratively pneumatic pressure, upon the blisters and channels. Accordingly, in embodiments employing pressure, the pouch material is flexible enough to allow the pressure to have the desired effect. The term "flexible" is used herein to describe a physical characteristic of the material of pouch. The term "flexible" is defined herein as readily deformable by the operative levels of pressure without cracking, breaking, crazing, or the like. For example, thin plastic sheets, such as Saran™ wrap and Ziploc® bags, as well as thin metal foil, such as aluminum foil, are flexible. However, only certain regions of the blisters and channels need be flexible, even in embodiments employing pneumatic pressure. Further, only one side of the blisters and channels need to be flexible, as long as the blisters and channels are readily deformable. Other regions of the pouch 510 may be made of a rigid material or may be reinforced with a rigid material.

Illustratively, a plastic film is used for pouch 510. A sheet of metal, such as aluminum, or another suitable material, can be milled or otherwise cut, to create a die having a pattern of raised surfaces. When fitted into a pneumatic press (illustratively A-5302-PDS, Janesville Tool Inc., Milton Wis.), illustratively regulated at an operating temperature of 195° C., the pneumatic press works like a printing press, melting the sealing surfaces of plastic film only where the die contacts the film. Various components, such as PCR primers (illustratively spotted onto the film and dried), antigen binding substrates, magnetic beads, and zirconium silicate beads can be sealed inside various blisters as the pouch 510 is formed. Additionally, or alternatively, reagents for sample processing can be spotted onto the film prior to sealing, either collectively or separately. In an embodiment, nucleotide tri-phosphates (NTPs) are spotted onto the film separately from polymerase and primers, essentially eliminating activity of the polymerase until the reaction is hydrated by an aqueous sample. If the aqueous sample has been heated prior to hydration, this creates the conditions for a true hot-start PCR and reduces or eliminates the need for expensive chemical hot-start components.

Pouch 510 may be used in a manner similar to that described in the '295 patent. In one illustrative embodiment, a 300 μL mixture comprising the sample to be tested (100 μL) and lysis buffer (200 μL) is injected into an injection port (not shown) in fitment 590 near entry channel 515*a*, and the sample mixture is drawn into entry channel 515*a*. Water is also injected into a second injection port (not shown) of the fitment 590 adjacent entry channel 515*l*, and is distributed via a channel (not shown) provided in fitment 590, thereby hydrating up to eleven different reagents, each of which were previously provided in dry form at entry channels 515*b* through 515*l* via. Illustrative methods and devices for injecting sample and hydration fluid (e.g. water or buffer) are disclosed in U.S. Patent Publication No. 2014/0283945, herein incorporated by reference in its entirety, although it is understood that these methods and devices are illustrative only and other ways of introducing sample and hydration fluid into pouch 510 are within the scope of this disclosure. These reagents illustratively may include freeze-dried PCR reagents, DNA extraction reagents, wash solutions, immunoassay reagents, or other chemical entities. Illustratively, the reagents are for nucleic acid extraction, first-stage multiplex PCR, dilution of the multiplex reaction, and preparation of second-stage PCR reagents, as well as control reactions. In the embodiment shown in FIG. 1, the sample solution is injected in one injection port and water is injected in the other injection port; all other reagents are contained therein. After injection, the two injection ports may be sealed. Additional information on various configurations of pouch 510 and fitment 590 can be found in the '295 patent, which his already incorporated by reference.

After injection, the sample is moved from injection channel 515*a* to lysis blister 522 via channel 514. Lysis blister 522 is provided with beads or particles 534, such as ceramic beads, and is configured for vortexing via impaction using rotating blades or paddles provided within the FilmArray® instrument. Bead-milling, by shaking or vortexing the sample in the presence of lysing particles such as zirconium silicate beads 534, is an effective method to form a lysate. It is understood that, as used herein, terms such as "lyse," "lysing," and "lysate" are not limited to rupturing cells (or contents thereof); those terms should additionally include disruption of non-cellular particles, such as viral capsids (or contents thereof).

Figure 2:
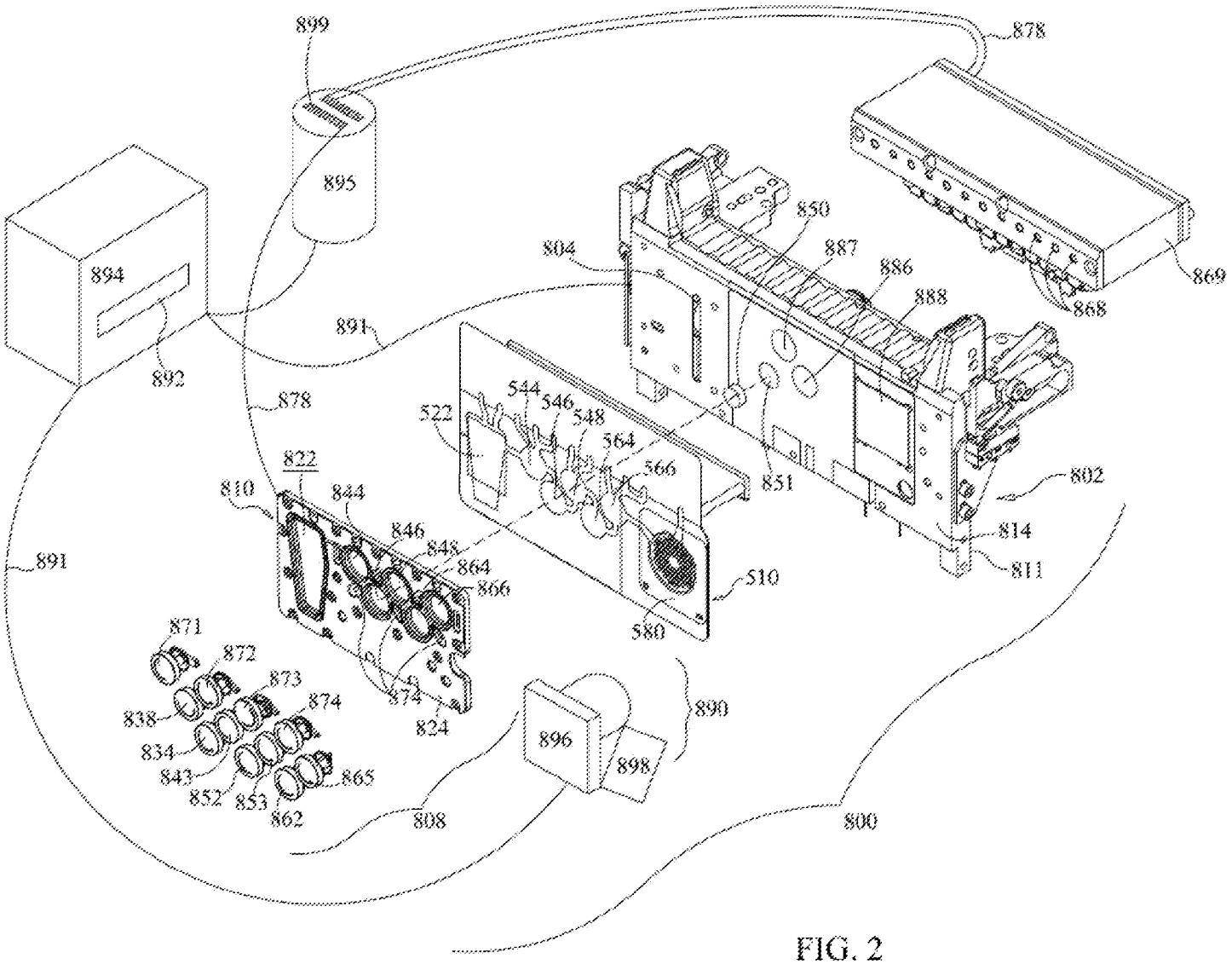
FIG. 2 is an exploded perspective view of an instrument for use with the pouch of FIG. 1, including the pouch of FIG. 1, according to an example embodiment of the present invention.
Figure 4:
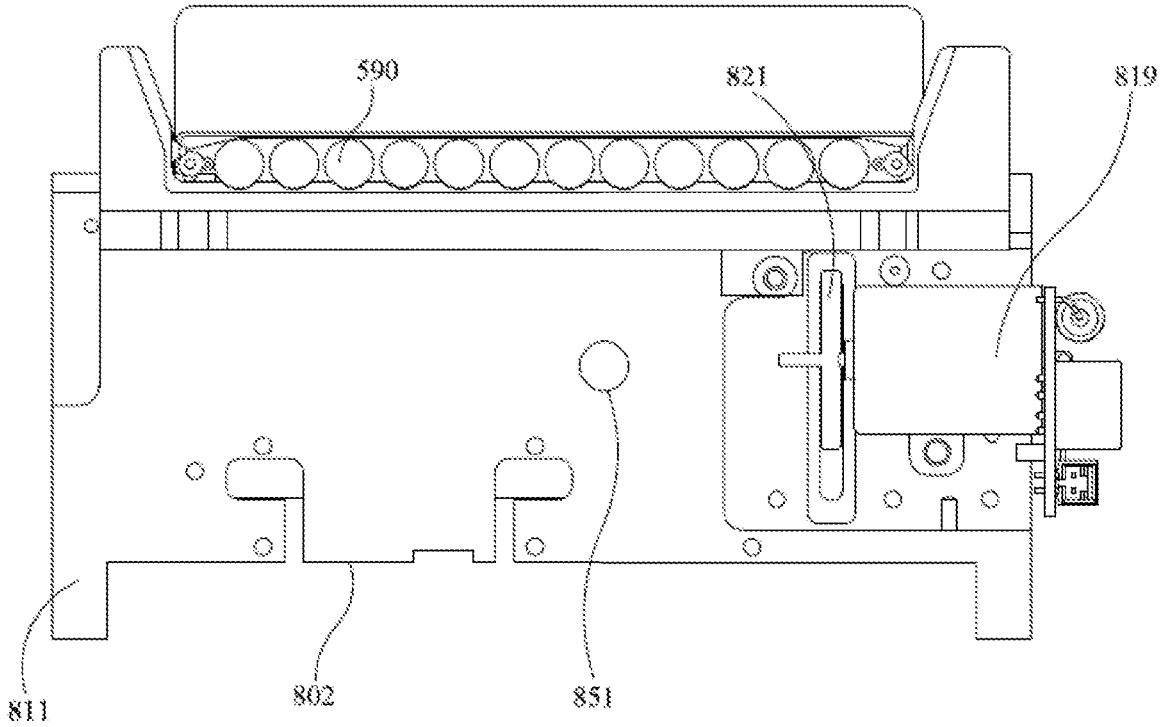
FIG. 4 shows a motor used in one illustrative embodiment of the instrument of FIG. 2.

FIG. 4 shows a bead beating motor 819, comprising blades 821 that may be mounted on a first side 811 of support member 802, of instrument 800 shown in FIG. 2. Blades may extend through slot 804 to contact pouch 510. It is understood, however, that motor 819 may be mounted on other structures of instrument 800. In one illustrative embodiment, motor 819 is a Mabuchi RC-280SA-2865 DC Motor (Chiba, Japan), mounted on support member 802. In one illustrative embodiment, the motor is turned at 5,000-25,000 rpm, more illustratively 10,000-20,000 rpm, and still more illustratively approximately 15,000-18,000 rpm. For the Mabuchi motor, it has been found that 7.2V provides sufficient rpm for lysis. It is understood, however, that the actual speed may be somewhat slower when the blades 821 are impacting pouch 510. Other voltages and speeds may be used for lysis depending on the motor and paddles used. Optionally, controlled small volumes of air may be provided into the bladder 822 adjacent lysis blister 522. It has been found that in some embodiments, partially filling the adjacent bladder with one or more small volumes of air aids in positioning and supporting lysis blister during the lysis process. Alternatively, other structure, illustratively a rigid or compliant gasket or other retaining structure around lysis blister 522, can be used to restrain pouch 510 during lysis. It is also understood that motor 819 is illustrative only, and other devices may be used for milling, shaking, or vortexing the sample.

Once the sample material has been adequately lysed, the sample is moved to a nucleic acid extraction zone, illustratively through channel 538, blister 544, and channel 543, to blister 546, where the sample is mixed with a nucleic acid-binding substance, such as silica-coated magnetic beads 533. Alternatively, magnetic beads 533 may be moved through channel 543 to blister 544, and then through channel 538 to blister 522. The mixture is allowed to incubate for an appropriate length of time, illustratively approximately 10 seconds to 10 minutes. A retractable magnet located within the instrument adjacent blister 546 captures the magnetic beads 533 from the solution, forming a pellet against the interior surface of blister 546. If incubation takes place in blister 522, multiple portions of the solution may need to be moved to blister 546 for capture. The liquid is then moved out of blister 546 and back through blister 544 and into blister 522, which is now used as a waste receptacle. One or more wash buffers from one or more of injection channels 515*c* to 515*e* are provided via blister 544 and channel 543 to blister 546. Optionally, the magnet is retracted and the magnetic beads 533 are washed by moving the beads back and forth from blisters 544 and 546 via channel 543. Once the magnetic beads 533 are washed, the magnetic beads 533 are recaptured in blister 546 by activation of the magnet, and the wash solution is then moved to blister 522. This process may be repeated as necessary to wash the lysis buffer and sample debris from the nucleic acid-binding magnetic beads 533.

After washing, elution buffer stored at injection channel 515*f* is moved to blister 548, and the magnet is retracted. The solution is cycled between blisters 546 and 548 via channel 552, breaking up the pellet of magnetic beads 533 in blister 546 and allowing the captured nucleic acids to dissociate from the beads and come into solution. The magnet is once again activated, capturing the magnetic beads 533 in blister 546, and the eluted nucleic acid solution is moved into blister 548.

First-stage PCR master mix from injection channel 515*g* is mixed with the nucleic acid sample in blister 548. Optionally, the mixture is mixed by forcing the mixture between 548 and 564 via channel 553. After several cycles of mixing, the solution is contained in blister 564, where a pellet of first-stage PCR primers is provided—at least one set of primers for each target—and first-stage multiplex PCR is performed. If RNA targets are present, a reverse transcriptase step may be performed prior to or simultaneously with the first-stage multiplex PCR. First-stage multiplex PCR temperature cycling in the FilmArray® instrument is illustratively performed for 15-20 cycles, although other levels of amplification may be desirable, depending on the requirements of the specific application. The first-stage PCR master mix may be any of various master mixes, as are known in the art. In one illustrative example, the first-stage PCR master mix may be any of the chemistries disclosed in U.S. Patent Publication No. 2015/0118715, herein incorporated by reference, for use with PCR protocols taking 20 seconds or less per cycle.

After first-stage PCR has proceeded for the desired number of cycles, the sample may be diluted, illustratively by forcing most of the sample back into blister 548, leaving only a small amount in blister 564, and adding second-stage PCR master mix from injection channel 515*i*. Alternatively, a dilution buffer from 515*i* may be moved to blister 566 then mixed with the amplified sample in blister 564 by moving the fluids back and forth between blisters 564 and 566. If desired, dilution may be repeated several times, using dilution buffer from injection channels 515*j* and 515*k*, or injection channel 515*k* may be reserved for sequencing or for other post-PCR analysis, and then adding second-stage PCR master mix from injection channel 515*h* to some or all of the diluted amplified sample. It is understood that the level of dilution may be adjusted by altering the number of dilution steps or by altering the percentage of the sample discarded prior to mixing with the dilution buffer or second-stage PCR master mix comprising components for amplification, illustratively a polymerase, dNTPs, and a suitable buffer, although other components may be suitable, particularly for non-PCR amplification methods. If desired, this mixture of the sample and second-stage PCR master mix may be pre-heated in blister 564 prior to movement to second-stage wells 582 for second-stage amplification. Such preheating may obviate the need for a hot-start component (antibody, chemical, or otherwise) in the second-stage PCR mixture.

The illustrative second-stage PCR master mix is incomplete, lacking primer pairs, and each of the 102 second-stage wells 582 is pre-loaded with a specific PCR primer pair. If desired, second-stage PCR master mix may lack other reaction components, and these components may be pre-loaded in the second-stage wells 582 as well. Each primer pair may be similar to or identical to a first-stage PCR primer pair or may be nested within the first-stage primer pair. Movement of the sample from blister 564 to the second-stage wells 582 completes the PCR reaction mixture. Once high density array 581 is filled, the individual second-stage reactions are sealed in their respective second-stage blisters by any number of means, as is known in the art. Illustrative ways of filling and sealing the high density array 581 without cross-contamination are discussed in the '295 patent, already incorporated by reference. Illustratively, the various reactions in wells 582 of high density array 581 are simultaneously thermal cycled, illustratively with one or more Peltier devices, although other means for thermal cycling are known in the art.

In certain embodiments, second-stage PCR master mix contains the dsDNA binding dye LCGreen® Plus (BioFire Diagnostics, LLC) to generate a signal indicative of amplification. However, it is understood that this dye is illustrative only, and that other signals may be used, including other dsDNA binding dyes and probes that are labeled fluorescently, radioactively, chemiluminescently, enzymatically, or the like, as are known in the art. Alternatively, wells 582 of array 581 may be provided without a signal, with results reported through subsequent processing.

Figure 3:
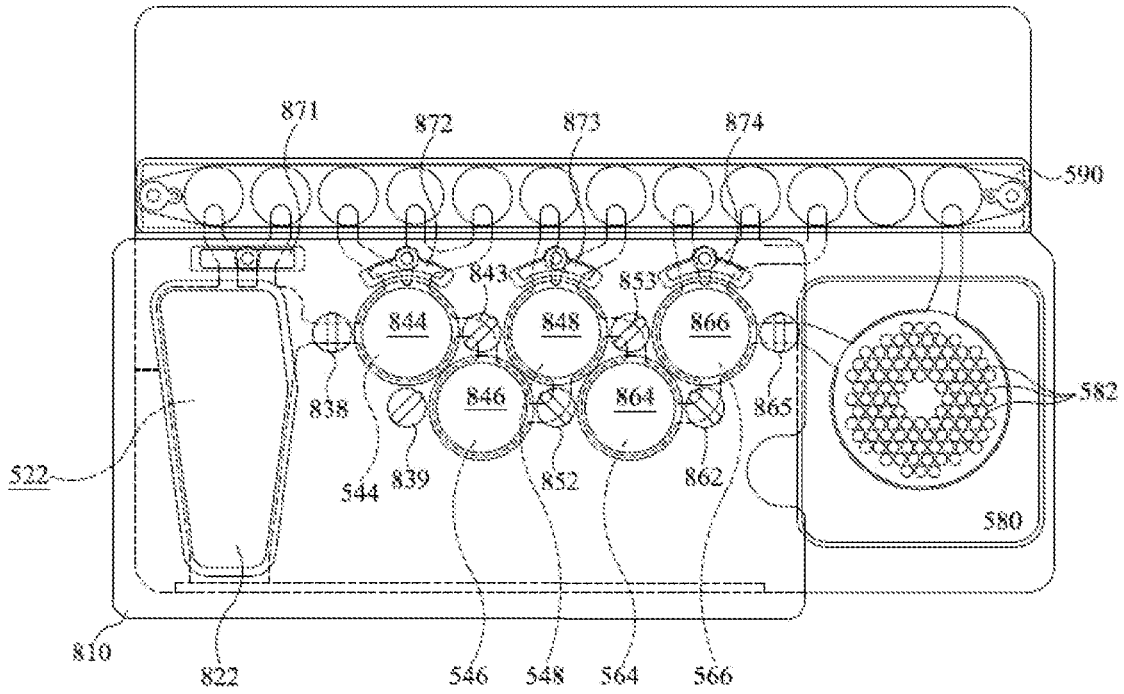
FIG. 3 shows a partial cross-sectional view of the instrument of FIG. 2, including the bladder components of FIG. 2, with the pouch of FIG. 1 shown in dashed lines.

When pneumatic pressure is used to move materials within pouch 510, in one embodiment a "bladder" may be employed. The bladder assembly 810, a portion of which is shown in FIGS. 2 and 3, includes a bladder plate 824 housing a plurality of inflatable bladders 822, 844, 846, 848, 864, and 866, each of which may be individually inflatable, illustratively by a compressed gas source. Because the bladder assembly 810 may be subjected to compressed gas and used multiple times, the bladder assembly 810 may be made from tougher or thicker material than the pouch. Alternatively, bladders 822, 844, 846, 848, 864, and 866 may be formed from a series of plates fastened together with gaskets, seals, valves, and pistons. Other arrangements are within the scope of this invention.

Success of the secondary PCR reactions is dependent upon template generated by the multiplex first-stage reaction. Typically, PCR is performed using DNA of high purity. Methods such as phenol extraction or commercial DNA extraction kits provide DNA of high purity. Samples processed through the pouch 510 may require accommodations be made to compensate for a less pure preparation. PCR may be inhibited by components of biological samples, which is a potential obstacle. Illustratively, in hot-start PCR, higher concentration of Taq polymerase enzyme, adjustments in $MgCl_2$ concentration, adjustments in primer concentration, and addition of adjuvants (such as DMSO, TMSO, or glycerol) optionally may be used to compensate for lower nucleic acid purity. While purity issues are likely to be more of a concern with first-stage amplification, it is understood that similar adjustments may be provided in the second-stage amplification as well.

When pouch 510 is placed within the instrument 800, the bladder assembly 810 is pressed against one face of the pouch 510, so that if a particular bladder is inflated, the pressure will force the liquid out of the corresponding blister in the pouch 510. In addition to bladders corresponding to many of the blisters of pouch 510, the bladder assembly 810 may have additional pneumatic actuators, such as bladders or pneumatically-driven pistons, corresponding to various channels of pouch 510. FIGS. 2 and 3 show an illustrative plurality of pistons or hard seals 838, 843, 852, 853, and 865 that correspond to channels 538, 543, 553, and 565 of pouch 510, as well as seals 871, 872, 873, 874 that minimize backflow into fitment 590. When activated, hard seals 838, 843, 852, 853, and 865 form pinch valves to pinch off and close the corresponding channels. To confine liquid within a particular blister of pouch 510, the hard seals are activated over the channels leading to and from the blister, such that the actuators function as pinch valves to pinch the channels shut. Illustratively, to mix two volumes of liquid in different blisters, the pinch valve actuator sealing the connecting channel is activated to open the channel, and the pneumatic bladders over the blisters are alternately pressurized, forcing the liquid back and forth through the channel connecting the blisters to mix the liquid therein. The pinch valve actuators may be of various shapes and sizes and may be configured to pinch off more than one channel at a time.

While pneumatic actuators are discussed herein, it is understood that other ways of providing pressure to the pouch are contemplated, including various electromechanical actuators such as linear stepper motors, motor-driven cams, rigid paddles driven by pneumatic, hydraulic or electromagnetic forces, rollers, rocker-arms, and in some cases, cocked springs. In addition, there are a variety of methods of reversibly or irreversibly closing channels in addition to applying pressure normal to the axis of the channel. These include kinking the plastic across the channel, heat-sealing, rolling an actuator, and a variety of physical valves sealed into the channel such as butterfly valves and ball valves. Additionally, small Peltier devices or other temperature regulators may be placed adjacent the channels and set at a temperature sufficient to freeze the fluid, effectively forming a seal. Also, while the design of FIG. 1 is adapted for an automated instrument featuring actuator elements positioned over each of the blisters and channels, it is also contemplated that the actuators could remain stationary, and the pouch 510 could be transitioned in one or two dimensions such that a small number of actuators could be used for several of the processing stations including sample disruption, nucleic-acid capture, first and second-stage PCR, and other applications of the pouch 510 such as immuno-assay and immuno-PCR. Rollers acting on channels and blisters could prove particularly useful in a configuration in which the pouch 510 is translated between stations. Thus, while pneumatic actuators are used in the presently disclosed embodiments, when the term "pneumatic actuator" is used herein, it is understood that other actuators and other ways of providing pressure may be used, depending on the configuration of the pouch and the instrument.

Other prior art instruments teach PCR within a sealed flexible container. See, e.g., U.S. Pat. Nos. 6,645,758; and 6,780,617; and 9,586,208, herein incorporated by reference. However, including the cell lysis within the sealed PCR vessel can improve ease of use and safety, particularly if the sample to be tested may contain a biohazardous material. In the embodiments illustrated herein, the waste from cell lysis, as well as that from all other steps, remains within the sealed pouch. Nonetheless, it is understood that the pouch contents could be removed for further testing.

FIG. 2 shows an illustrative instrument 800 having heaters 886, 887, 888 that heat a sample, such as that contained within pouch 510. Instrument 800 includes a support member 802 that could form a wall of a casing or be mounted within a casing. Instrument 800 may also include a second support member (not shown) that is optionally movable with respect to support member 802, to allow insertion and withdrawal of pouch 510. Illustratively, a lid may cover pouch 510 once pouch 510 has been inserted into instrument 800. In another embodiment, both support members may be fixed, with pouch 510 held into place by other mechanical means or by pneumatic pressure.

In the illustrative example, heaters 886, 887, 888 are mounted on support member 802. However, it is understood that this arrangement is illustrative only and that other arrangements are possible. Illustrative heaters include Peltiers and other block heaters, resistance heaters, electromagnetic heaters, and thin film heaters, with one or more controller for adjusting electrical current through the heater to thermocycle the contents of blister 864 and second-stage reaction zone 580. Bladder plate 810, with bladders 822, 844, 846, 848, 864, 866, hard seals 838, 843, 852, 853, seals 871, 872, 873, 874 form bladder assembly 808 may illustratively be mounted on a moveable support structure that may be moved toward pouch 510, such that the pneumatic actuators are placed in contact with pouch 510. When pouch 510 is inserted into instrument 800 and the movable support member is moved toward support member 802, the various blisters of pouch 510 are in a position adjacent to the various bladders of bladder assembly 810 and the various seals of assembly 808, such that activation of the pneumatic actuators may force liquid from one or more of the blisters of pouch 510 or may form pinch valves with one or more channels of pouch 510. The relationship between the blisters and channels of pouch 510 and the bladders and seals of assembly 808 is illustrated in more detail in FIG. 3.

First-stage heater 886 of FIG. 2 may be positioned to heat and cool the contents of blister 564 for first-stage PCR. Optionally, heater 887 may be provided to control the temperature of the contents of blister 548, where heaters 886 and 887 are controlled together and cycle together. In another embodiment, heaters 886 and 887 may be under separate control, illustratively heater 887 may be provided to maintain a suitable annealing temperature, while blister 886 may be provided to maintain a suitable denaturation temperature, although it is understood that this is illustrative only and that the heaters may be reversed. Other configurations are possible. Two temperature PCR using two heating zones is discussed more fully in U.S. Pat. No. 9,586,208, already incorporated by reference in its entirety.

Figure 6:
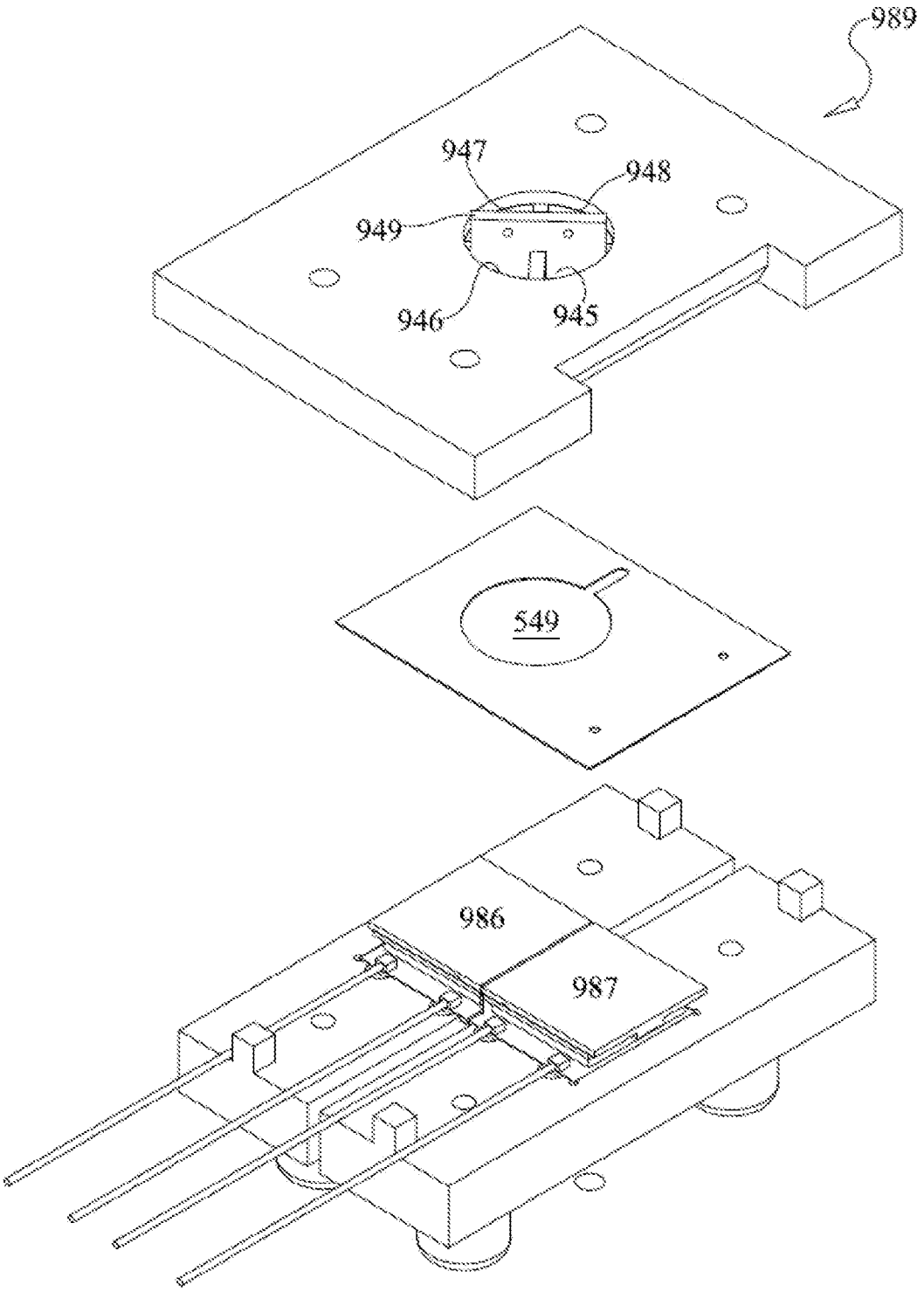
FIG. 6 is an exploded view of an alternative heating embodiment for first-stage PCR for the instrument of FIG. 2.
Figure 7:
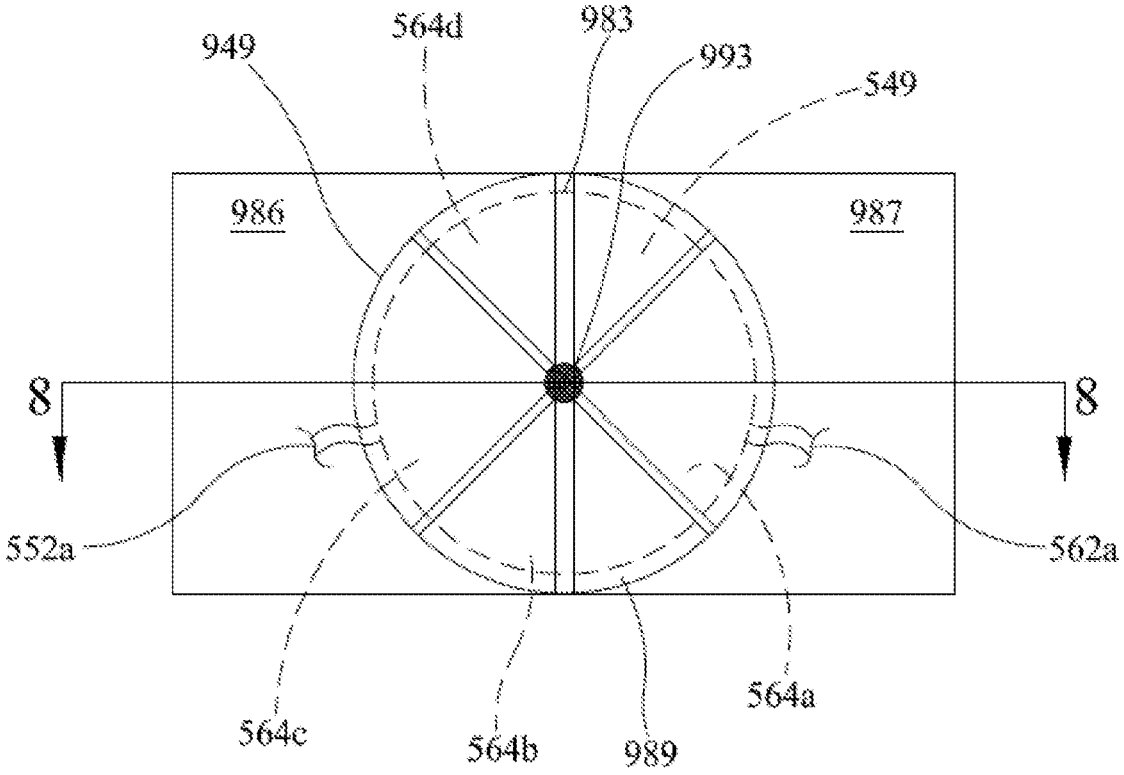
FIG. 7 is a top view of the heating format of FIG. 6.
Figure 8:
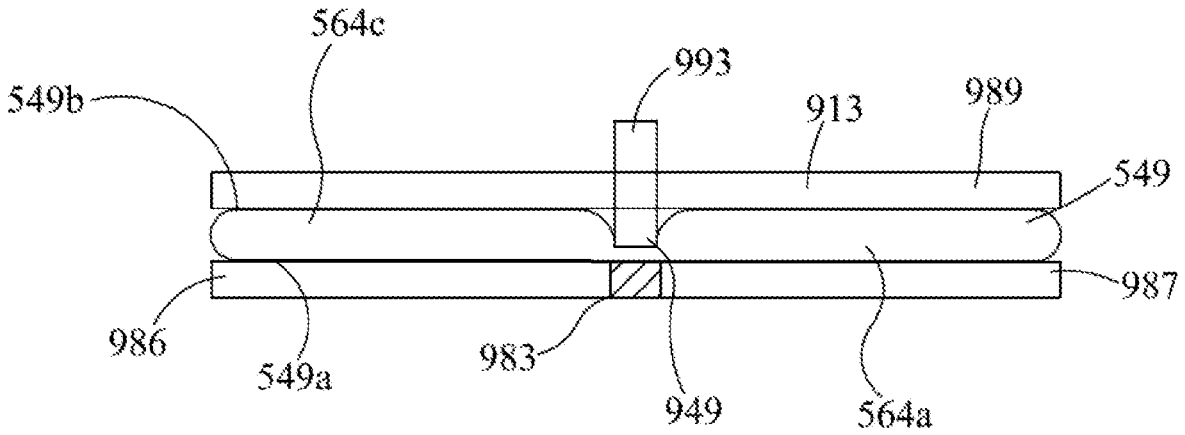
FIG. 8 is a cross-sectional view of the sample vessel positioned on the alternative heating embodiment of FIG. 6.

By thermocycling heaters 886, 887, 888, run time for the PCR portions necessarily need to be at least as long as the heater takes to get to a suitable temperature at each transition. It is understood that run time could be reduced if the temperature of the heaters do not need to be changed. FIGS. 6-8 show an embodiment for the first-stage PCR amplification having at least two heaters held at constant temperatures. In this illustrative embodiment, blisters 548 and 564 may be replaced with a single blister 549, and the illustrative instrument is provided with two heaters 986 and 987. However, it is understood that one of blisters 548 or 564 may be used and smaller heaters 986, 987 may be used. Heaters 986, 987 may be Peltiers, resistance heaters, electromagnetic heaters, thin film heaters, printed element heaters, positive temperature coefficient heaters, or other heaters as are known in the art, including any of the heaters described herein.

Figure 5A:
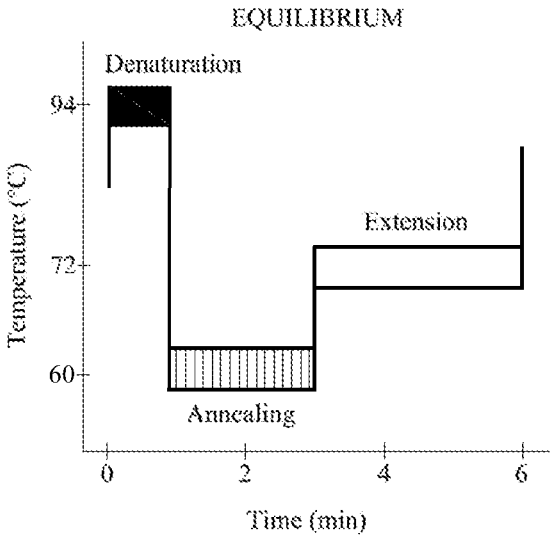
FIGS. 5*a*-5*b* show illustrative profiles for an equilibrium paradigm (FIG. 5*a*) and a kinetic paradigm (FIG. 5*b*) of PCR. A solid black box represents denaturation, a striped box represents annealing, and a solid white box represents extension of the nucleic acids during thermal cycling.

In some embodiments, thermocycling and subsequent nucleic acid amplification is performed under an equilibrium paradigm, such as that depicted in FIG. 5*a*. Briefly, under an equilibrium paradigm, the sample is brought to a denaturation temperature and maintained at the denaturation temperature for a period of time. The sample is then cooled to an annealing temperature for another period of time followed by heating to a third temperature, the extension temperature. An exemplary equilibrium paradigm protocol could be heating the sample to 94° C. for 30 seconds, followed by annealing at 60° C. for 1 minute, followed by extending at 72° C. for 2 minutes to complete a first amplification cycle. The same three temperatures—denaturing, annealing, and extending—are repeated in the same aforementioned order for each additional amplification cycle.

Figure 5B:
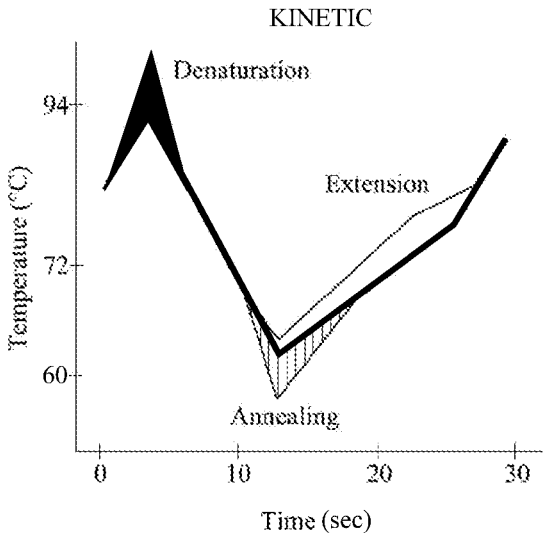

In some embodiments, thermocycling and subsequent nucleic amplification is performed under a kinetic paradigm, such as that depicted in FIG. 5*b*. A kinetic paradigm is often associated with rapid cycle PCR protocols and emphasizes temperature transitions rather than discreet, static temperature zones for performing each of denaturation, annealing, or extension. Briefly, under a kinetic paradigm, the sample alternates between a denaturation temperature and an annealing temperature with little to no time spent at either extreme temperature. In some embodiments, a single heating element is used, and when the heater reaches the denaturation temperature, it cools to the annealing temperature, followed by heating to the denaturation temperature, and so forth. The sample concurrently heats and cools between the denaturation temperature and the annealing temperature, with extension of the primers occurring during the transition between annealing and denaturation temperatures (as exemplified in FIG. 5*b*). In some implementations, multiple heaters can be used. For example, two heaters can be used—a first heater held at the denaturation temperature and the second heater held at the annealing temperature. The sample can transition between heating elements or the heating elements can be cyclically applied to the sample, being switched when the sample reaches the desired temperature.

While heaters 886 and/or 887 may thermocycle between an annealing and a denaturation temperature, in one example illustrated in FIG. 6, heater 986 may be provided at a suitable denaturation temperature, illustratively 94° C., and heater 987 may be provided at a suitable annealing temperature, illustratively 60° C., although other illustrative denaturation and annealing temperatures may be used, as are known in the art. In some embodiments, it may be desirable to set heater 986 higher than 94° C. and set heater 987 at a temperature lower than 60° C., as fluid may be circulated through control of each of these heaters quickly as the fluid reaches temperature, thereby increasing ramp rate. Such embodiments may be suited for use with enhanced primer and polymerase concentrations. Illustratively, an insulating spacer 983 is provided between heater 986 and heater 987. Any suitable insulating material may be used, including foam, plastic, rubber, air, vacuum, glass, or any other suitable material illustratively of low conductivity. In embodiments where heaters 986 and 987 are held at a generally constant temperature, run time and energy usage may be substantially reduced.

In the illustrative example, a wiper 989 engages top surface 549*b* of blister 549. When fluid is moved into blister 549, wiper 989 is moved so that body 913 of wiper 989 forces blister 549 into contact with heaters 986, 987, so that a portion of blister 549 is in contact with each of the heaters, to permit thermal transfer from each of the heaters to a portion of blister 549. In the illustrative embodiment, wiper 989 has an x-shaped blade 949 that divides wiper 989 into four sections 945, 946, 947, 948. When engaged, blade 949 contacts blister 549 with enough pressure such that blade 949 divides blister 549 into corresponding four sections, 564*a*, 564*b*, 564*c*, 564*d*, and rotation of wiper 989 around axis 993 forces fluid within blister 549 into a circular motion around blister 549. Illustratively, blade 949 is a rubber or elastomeric material, or a non-stick material such as Teflon or Delrin having enough stiffness to divide blister 549 into sections and to move fluid within blister 549, but not puncture or tear blister 549, although it is understood that such materials are illustrative only and that other materials may be used, as are known in the art. The blade can also include rollers or other configurations to allow movement of fluid within blister 549. In one embodiment, the blade allows portions of the fluid to be heated by each of the heaters simultaneously, and moves portions of fluid from temperature control of one heater while permitting other portions of fluid to be under control of the other heater. Wiper 989 and blade 949 can be moved into position and rotated by any motor, cam, crank, gear mechanism, hydraulics, pneumatics, or other means, as are known in the art. It is understood that wiper body 913 and blade 949 can be a single fixed unit and move as a single fixed unit, or body 913 can be moved into and out of contact with blister 549 independently of movement of blade 949. It is also understood that the circular shape of blister 549 and rotational motion is illustrative only, and that other sample vessel shapes are possible, as are non-rotational movement of the blade or rollers, such as linear, curvilinear, and semi-circular motions.

As discussed above, wiper 989 is provided with an X-shaped blade 849, thereby partitioning wiper into four segments 945, 946, 947, 948, as best seen in FIG. 6, and similarly dividing blister 549 into four segments 549*a*, 549*b*, 549*c*, and 549*d*, as best seen in FIG. 7. However, it is understood that this is illustrative only, and that any shape of blade 849 may be used, including a single linear blade illustratively substantially corresponding to a diameter of blister 549, a single or multiple non-linear blade including an s-shaped blade or a spiral blade, a single blade corresponding to a radius of blister 549 (e.g., similar to a clock hand), and multiple blades that divide blister 549 into multiple segments. It is understood that blades that divide blister 549 into multiple similar segments likely provide more controlled heating between different segments where entire segments will be at the annealing and denaturation temperatures at one time, whereas s-shaped, spiral, and radial blades may generate multiple vortexes, eddies, and varied mixing patterns, to move the sample across the thermal surface created by heaters 986, 987. It is also understood that less blade material allows for more of the sample to be in close contact with the heaters, while more blade material better controls fluid movement. Whatever the blade pattern, it is understood that portions of the fluid in blister 549 will be at the annealing temperature, while other portions will be at the denaturation temperature, and yet other portions in transition between the temperatures, all within a single sample container. The choice of shape for blade 949 may depend on size and thickness of the blister and size of the heaters, and the desirability of using wiper 989 for expelling material from blister 549 once first-stage thermal cycling has been completed.

In the illustrative embodiment, heaters 986, 987 provide a flat surface against which blister 549 may be pressed. However, it is understood that this is illustrative only, and heaters 986, 987 may provide a textured surface to aid in mixing for sample uniformity.

In the illustrative embodiment, heaters 986 and 987 are each provided at fixed temperatures, illustratively 94° C. and 60° C., respectively. However, it may be desirable to adjust the temperature of heaters 986 and 987 in some embodiments. For example, it may be desirable to increase the temperature of one or both heaters when the sample is first introduced to blister 549, to compensate for a cooler temperature of the fluid as it enters blister 549. Additionally, while two heaters are shown, any number of heaters may be used. One illustrative example uses three heaters, with one set at a denaturation temperature, one set at an annealing temperature, and the third set at an elongation temperature. In another illustrative sample, a first heater is larger than a second heater, so that the sample stays at the first temperature for a longer portion of the cycle. Moreover, it is understood that blister 549 and its contents may remain stationary, and heaters 986, 987 may be rotated.

Illustratively, fluid may enter blister 549 through channel 552*a* from a nucleic acid extraction zone, illustratively similar to blister 546 of the pouch of FIG. 1, and channel 552*a* may then be closed. Body 913 then presses on blister 549, promoting contact of blister 549 with heaters 986 and 987, and blade 949 divides blister 549 into segments 549*a*, 549*b*, 549*c*, and 549*d*. As wiper 989 is rotated, sample in each of the four segments 549*a*, 549*b*, 549*c*, and 549*d* is moved from contact with heater 986 to contact with heater 987, and back again. The amount of time needed to heat and cool the sample in each of the segments is dependent on a number of factors, including the thickness of film on blister 549, the thickness of the fluid layer within blister 549, mixing of the sample within blister 549, and the amount of contact with the heaters. However, it is understood that one full revolution of wiper 989 generally corresponds to one cycle of PCR in this illustrative embodiment.

Once thermal cycling is complete, channel 562*a* may be opened. Illustratively, particularly when blade 949 is curved, the direction of wiper 989 may be used to pump fluid from blister 549 into channel 562*a*. Alternatively, blister 549 may be a stand-alone container for thermocycling a sample, such that blister 549 is sealed after receiving a PCR reaction. Blister 549 may be used for any of a variety of sample types that require thermocycling.

Turning back to FIG. 2, each pneumatic actuator is connected to compressed air source 895 via valves 899. While only several hoses 878 are shown in FIG. 2, it is understood that each pneumatic fitting is connected via a hose 878 to the compressed gas source 895. Compressed gas source 895 may be a compressor, or, alternatively, compressed gas source 895 may be a compressed gas cylinder, such as a carbon dioxide cylinder. Compressed gas cylinders are particularly useful if portability is desired. Other sources of compressed gas are within the scope of this invention.

Assembly 808 is illustratively mounted on a movable support member, although it is understood that other configurations are possible.

Several other components of instrument 810 are also connected to compressed gas source 895. A magnet 850, which is mounted on a second side 814 of support member 802, is illustratively deployed and retracted using gas from compressed gas source 895 via hose 878, although other methods of moving magnet 850 are known in the art. Magnet 850 sits in recess 851 in support member 802. It is understood that recess 851 can be a passageway through support member 802, so that magnet 850 can contact blister 546 of pouch 510. However, depending on the material of support member 802, it is understood that recess 851 need not extend all the way through support member 802, as long as when magnet 850 is deployed, magnet 850 is close enough to provide a sufficient magnetic field at blister 546, and when magnet 850 is retracted, magnet 850 does not significantly affect any magnetic beads 533 present in blister 546. While reference is made to retracting magnet 850, it is understood that an electromagnet may be used and the electromagnet may be activated and inactivated by controlling flow of electricity through the electromagnet. Thus, while this specification discusses withdrawing or retracting the magnet, it is understood that these terms are broad enough to incorporate other ways of withdrawing the magnetic field. It is understood that the pneumatic connections may be pneumatic hoses or pneumatic air manifolds, thus reducing the number of hoses or valves required.

The various pneumatic pistons 868 of pneumatic piston array 869 are also connected to compressed gas source 895 via hoses 878. Twelve pneumatic pistons 868 are shown. While only two hoses 878 are shown connecting pneumatic pistons 868 to compressed gas source 895, it is understood that each of the pneumatic pistons 868 are directly or indirectly connected to compressed gas source 895.

A pair of heating/cooling devices, illustratively Peltier heaters, are mounted on a second side 814 of support 802. As discussed above, first-stage heater 886 is positioned to heat and cool the contents of blister 564 for first-stage PCR. As seen in FIG. 2, second-stage heater 888 is positioned to heat and cool the contents of second-stage blisters 582 of array 581 of pouch 510, for second-stage PCR. It is understood, however, that these heaters could also be used for other heating purposes, and that other heaters may be included, as appropriate for the particular application.

Figure 9:
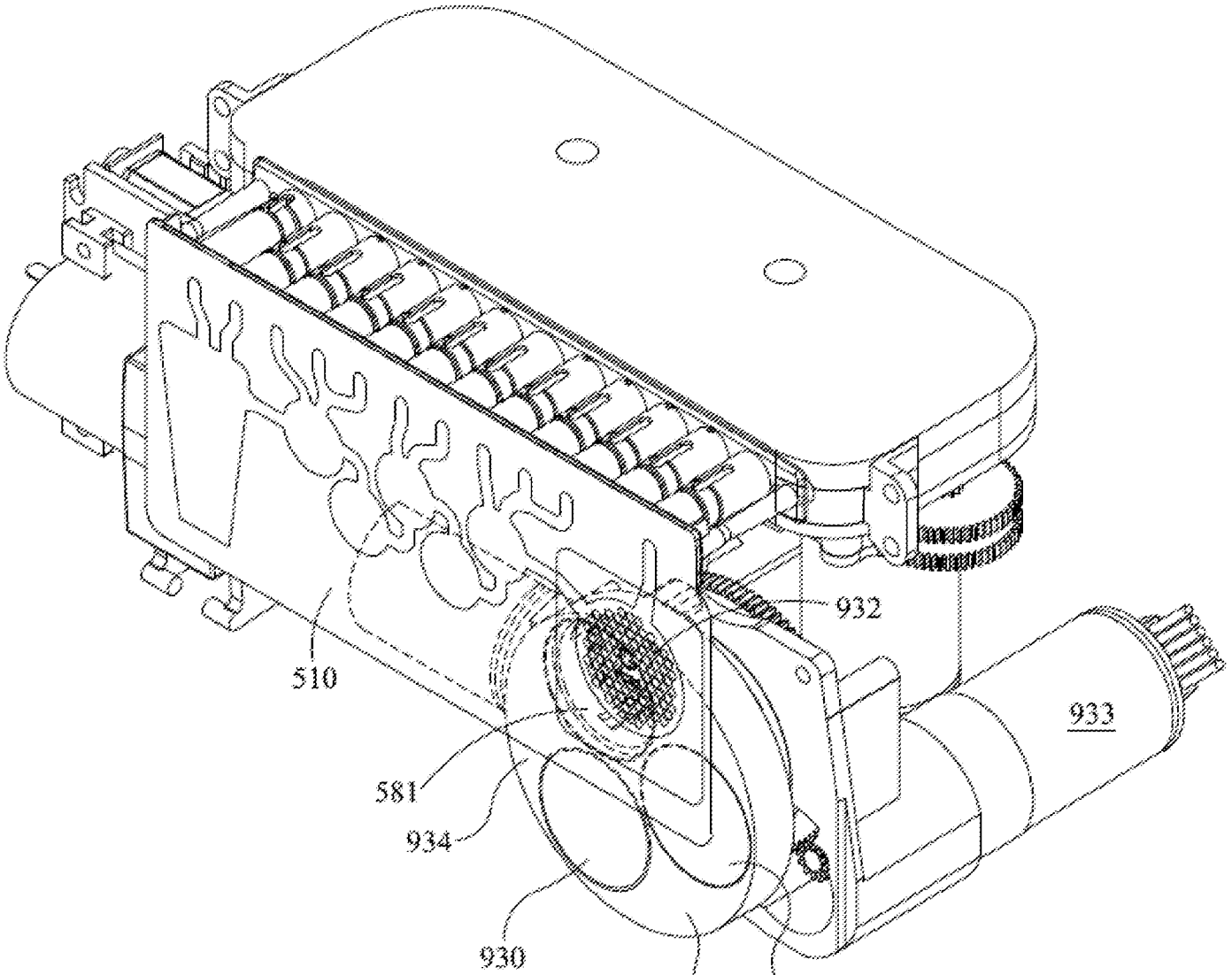
FIG. 9 is a perspective view of an alternative heating embodiment for second-stage PCR for the instrument of FIG. 2
Figure 10:
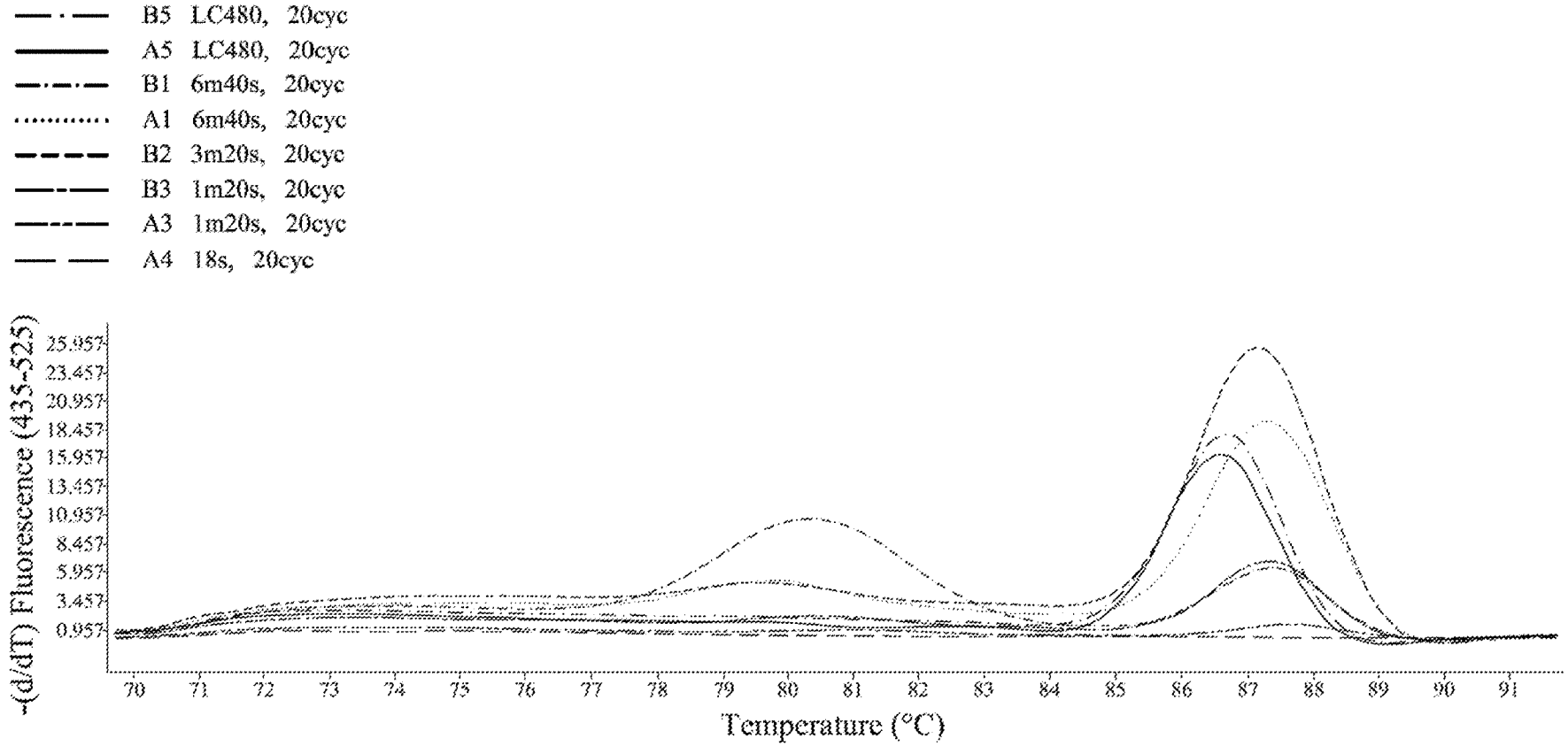
FIG. 10 shows results of amplification using a prototype of the instrument of FIGS. 6-8 in comparison to amplification using a standard plate-based thermocycler.
Figure 11:
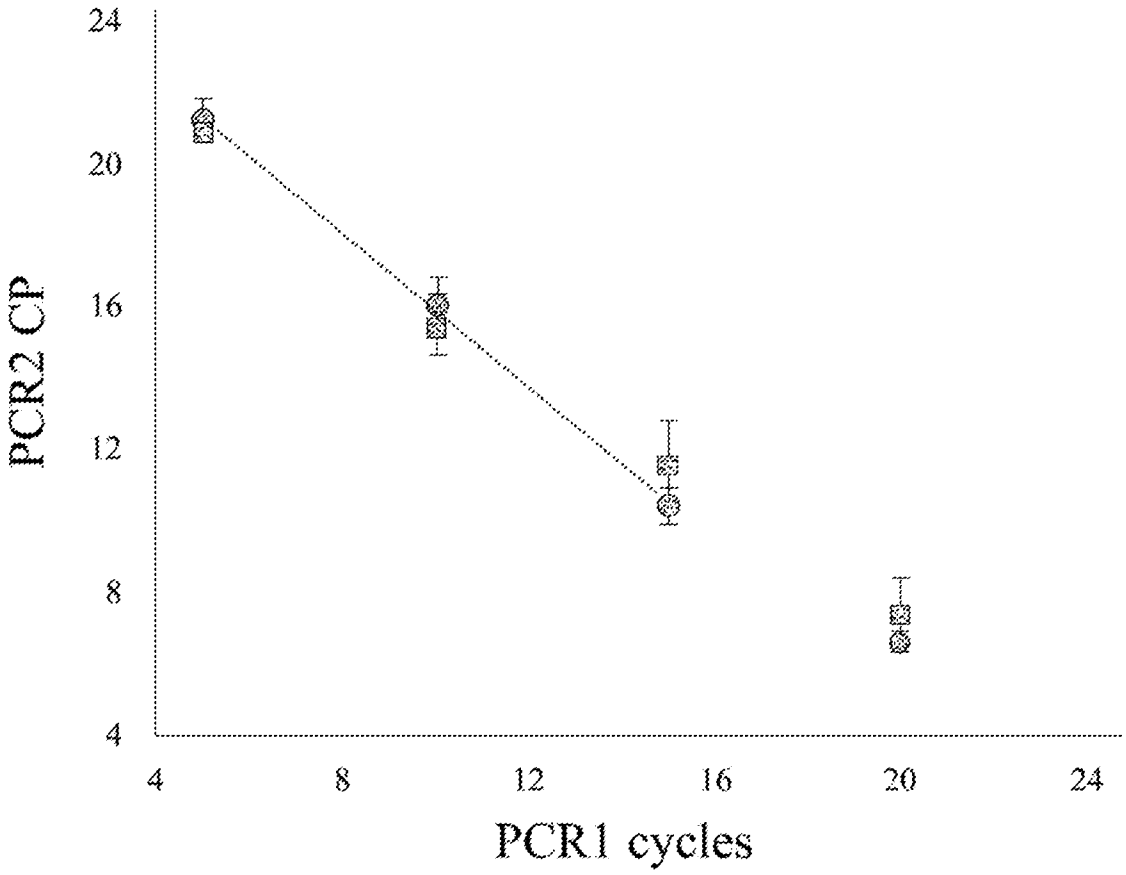
FIG. 11 shows a graph of the PCR2 Cp that results from running different numbers of cycles for PCR1 in a block thermocycler (circle) and the prototype wiper blade setup (square).

As discussed above, while Peltier heaters, which thermocycle between two or more temperatures, are effective for PCR, it is desirable in some embodiments to maintain heaters at a constant temperature. Illustratively, this can be used to reduce run time, by eliminating time needed to transition the heater temperature beyond the time needed to transition the sample temperature. FIG. 9 shows an alternative embodiment for second-stage heater 888, which is replaced by heater assembly 988. Illustratively, heater assembly 988 includes three heaters 930, 931, and 932, set in a circular mount 934, driven circularly by motor 933, so that one heater at a time contacts array 581 as each heater is moved sequentially into position adjacent array 581. Types of suitable heaters have been discussed above, with reference to first-stage PCR. Illustratively, heater 930 may be set at an annealing temperature, illustratively 60° C., heater 931 may be set at an elongation temperature, illustratively 72° C., and heater 932 may be set at a denaturation temperature, illustratively 94° C. However, it is understood that these temperatures are illustrative only, and that other temperatures and other numbers of heaters may be used. Two heaters are sufficient for many applications. For example, when performing a fast cycle PCR or other nucleic acid amplification protocol under a kinetic paradigm (e.g., FIG. 5*b*), a two heater assembly may be advantageous. Because it is difficult to move array 581 within pouch 510, heaters 930, 931, 932 move to contact array 581. Mount 934 may move in one direction only, with each of heaters 930, 931, 932 contacting array 581 in order, or mount may move in both clockwise and counterclockwise directions, illustratively changing direction after each PCR cycle.

While heaters 930, 931, 932 are provided in mount 934 and are moved relative to array 581, it is understood that this illustrative only, and that two or more stationary heaters may be provided, and array 581 may be rotated relative to the heaters, as with the embodiment shown in FIGS. 6-8 for first stage PCR.

When fluorescence detection is desired, an optical array 890 may be provided. As shown in FIG. 2, optical array 890 includes a light source 898, illustratively a filtered LED light source, filtered white light, or laser illumination, and a camera 896. Camera 896 illustratively has a plurality of photodetectors, each corresponding to a second-stage well 582 in pouch 510. Alternatively, camera 896 may take images that contain all of the second-stage wells 582, and the image may be divided into separate fields corresponding to each of the second-stage wells 582. Depending on the configuration, optical array 890 may be stationary, or optical array 890 may be placed on movers attached to one or more motors and moved to obtain signals from each individual second-stage well 582. It is understood that other arrangements are possible. The embodiment for second-stage heaters shown in FIG. 9 provides the heaters on the opposite side of pouch 510 from that shown in FIG. 2. Such orientation is illustrative only and is determined by spatial constraints within the instrument. Provided that second-stage reaction zone 580 is provided in an optically transparent material, photodetectors and heaters may be on either side of array 581 or moved into and out of position at the direction of a user or automatically at the direction of a computer.

As shown, a computer 894 controls valves 899 of compressed air source 895, and thus controls all of the pneumatics of instrument 800. Computer 894 also controls heaters 886 and 888, and optical array 890. Each of these components is connected electrically, illustratively via cables 891, although other physical or wireless connections are within the scope of this invention. It is understood that computer 894 may be housed within instrument 800 or may be external to instrument 800. Further, computer 894 may include built-in circuit boards that control some or all of the components, and may also include an external computer, such as a desktop or laptop PC, to receive and display data from the optical array. An interface, illustratively a keyboard interface, may be provided including keys for inputting information and variables such as temperatures, cycle times, etc. Illustratively, a display 892 is also provided. Display 892 may be an LED, LCD, or other such display, for example.

The performance of the illustrative instrument 800 described in relation to FIG. 2 through 11 may be at least partially dependent upon the performance and/or characteristics of the heaters 886, 887, 888, whether the heaters 886, 887, 888 are thermocycled or held at a constant temperature. In some embodiments, the PCR and illustrative instrument 800 described herein may include a heater according to the present disclosure.

Figure 12:
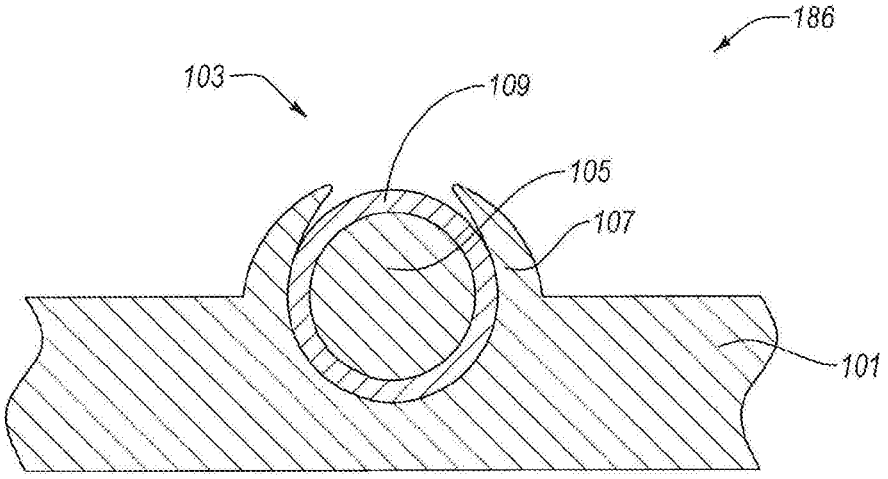
FIG. 12 shows a partial side cross-section of an embodiment of a heater, according to the present disclosure.

FIG. 12 illustrates a partial side cross-sectional view of an embodiment of a heater 186. The heater 186 may include a thermally conductive body 101 with a channel 103 formed therein. The channel 103 is configured to receive a heating element 105 positioned in the channel 103. The heating element 105 may be mechanically held against the body 101 by retention member 107. In embodiments with a resistive heating element 105 (i.e., a wire, foil, or other heating element that dissipates thermal energy when an electric current is applied therethrough), the heating element 105 may be electrically insulated from the body 101 and/or the retention member 107 by an electrical insulation layer 109.

In some embodiments, the body 101 may be made of or include a thermally conductive material, such as a metal, metal alloy, ceramic, polymer, other thermally conductive material, or combinations thereof. For example, the body 101 may include copper, copper alloys, aluminum, aluminum alloys, iron, iron alloys (e.g., steel), titanium, titanium alloys, nickel alloys, tungsten alloys, superalloys, silicon, silicon carbide, ceramics, composites, or combinations thereof. The body 101 may be made of a single material or a combination of materials. For example, the body 101 may include one or more materials laminated together.

The heating element 105 illustratively may be a resistive heating element, an inductive heating element, a fluid heating element, or combinations thereof. For example, a resistive heating element 105 may include a nickel-chromium wire that increases in temperature upon an electric current applied therethrough. In other examples, the resistive heating element may be a copper wire, a steel wire, an aluminum alloy wire, or other metals. An inductive heating element 105 may include a ferromagnetic material that increases in temperature upon exposure to an alternating magnetic field. A fluid heating element 105 may include a thermally controlled fluid that is moved through the heating element 105 to alter the temperature.

The channel 103 is shown with a circular cross-section. In other embodiments, the channel 103 may have other cross-sectional shapes, such as elliptical, rectangular, triangular, other polygonal, irregular, or combinations thereof. Similarly, the heating element 105 is shown with a circular cross-section. In other embodiments, the heating element 105 may have other cross-sectional shapes, such as elliptical, rectangular, triangular, other polygonal, irregular, or combinations thereof. While the channel 103 and the heating element 105 as depicted in FIG. 12 have substantially similar cross-sectional shapes, the cross-sectional shapes of the channel 103 and heating element 105 need not be the same. For example, the channel 103 may be substantially square in cross-section, while the heating element 105 may be circular in cross-section.

In embodiments of a heater 186 having a resistive heating element 105 and an electrically conductive body 101, the heating element 105 may be electrically insulated from the body 101 by an electrical insulation layer 109. In other embodiments, the body 101 may be electrically insulating and thermally conductive without the need for an electrical insulation layer 109. In embodiments with an electrically conductive body 101, the electrical insulation layer 109 may be at least partially located between the heating element 105 and the body 101 to prevent contact and, hence, electrical connection between the live resistive heating element 105 and the body 101.

In some embodiments, the electrical insulation layer 109 may be made of or include a polyimide film (such as poly (4,4'-oxydiphenylene-pyromellitimide) available as KAPTON from E. I. du Pont de Nemours and Company). For example, the electrical insulation layer 109 may have a thermal conductivity of no less than 0.46 W/m*K. In other embodiments, the electrical insulation layer 109 may include other electrically insulating polymers with a thermal conductively of no less than 0.40 W/m*K. The electrical insulation layer 109 may substantially prevent an electrical connection between the heating element 105 and an electrically conductive body 101.

A heater 186 according to the present disclosure may include a heating element 105 connected to the body 101 without an adhesive therebetween. For example, the heater 186 may include one or more retention members 107 connected to the body 101 that may mechanically connect or hold the heating element 105 adjacent to the body 101. As shown in FIG. 12, the retention members 107 may be integrally formed with the body 101. For example, the retention members 107 may be made of the same material as the body 101. In other embodiments, the retention members 107 may be bonded, such as welded, brazed, or otherwise adhered to the body 101. In yet other embodiments, the retention members 107 may be a part of a laminated layer applied to the body 101.

The retention members 107 may be movable between an initial open position in which the channel 103 is unobstructed by the retention members 107 and a closed position. For example, the retention members 107 may be made of a malleable or plastically deformable material and deformed from the open position to the closed position shown in FIG. 12. In the closed position, the retention members 107 may enclose at least part of the heating element 105 and, thereby, retain the heating element 105 within the channel 103. The mechanical retention of the heating element 105 in the channel 103 by the retention members 107 may allow the heating element 105 to be secured to the body 101 without the use of an adhesive between the heating element 105 and the body 101. An adhesive may thermally insulate the heating element 105 and reduce the overall efficiency of the heater 186.

The body 101 and retention members 107 (when in a closed position about the heating element 105) surround at least 50% of the heating element 105. In some embodiments, the body 101 and retention members 107 may surround a percentage of the heating element 105 in a range having upper and lower values including any of 50%, 60%, 70%, 80%, 90%, 100%, or any values therebetween. For example, the body 101 and retention members 107 may surround a percentage of the heating element 105 in a range of 50% to 100%. In other examples, the body 101 and retention members 107 may surround a percentage of the heating element 105 in a range of 60% to 100%. In yet other examples, the body 101 and retention members 107 may surround a percentage of the heating element 105 in a range of 70% to 100%. In at least one example, the body 101 and retention members 107 may surround a percentage of the heating element 105 in a range of 80% to 100%. The retention member surrounding percentages are illustrative only, and in an embodiment, the retention member surrounding percentage can be effectively greater than 100% by, for example, having the retention members overlap the heating element.

Figure 13:
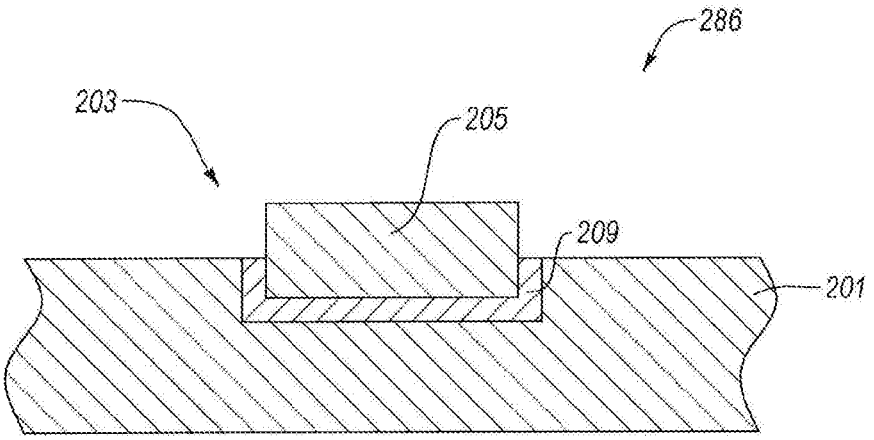
FIG. 13 shows a partial side cross-section of another embodiment of a heater, according to the present disclosure.

FIG. 13 illustrates a partial side cross-sectional view of another embodiment of a heater 286 according to the present disclosure. The heater 286 has a body 201 similar to that described in relation to FIG. 12. The body 201 has a channel 203 formed therein, with a heating element 205 positioned in the channel 203. The channel 203 may be rectangular in cross-section (i.e. having a flat bottom with orthogonal sidewalls). The heating element 205 may have a complimentary shape in cross-section, or may be deformed to have a complimentary cross-sectional shape.

For example, the channel 203 depicted in FIG. 13 does not have retention members as depicted in FIG. 12. The heater 286 may have a channel 203 into which the heating element 205 may be compressed to mechanically interlock the channel 203 and heating element 205. The mechanical interlock between the heating element 205 and the channel 203 may allow the heating element 205 to be retained in contact and/or adjacent to the body 201 without the use of adhesives. In the depicted embodiment, the heating element 205 may be compressed into the channel 203 with a press fit to secure the heating element 205 in the channel 203. In other embodiments, the heating element 205 may be deformed into a channel having a wider bottom than opening, such as a dovetail shape in cross-section, producing a mechanical interlock between the heating element 205 and the channel 203.

The heating element 205 may be approximately the same shape as the channel 203 prior to deforming the heating element 205 to create the mechanical interlock. In other embodiments, the heating element 205 may have a different cross-sectional shape prior to deformation. For example, the heating element 205 may be a round drawn copper wire initially, and the channel 203 may be substantially rectangular in cross-section until the wire heating element 205 is compressed into the channel 203. In another example, the heating element 205 may be a laser-cut nickel chromium foil that is rectangular in cross-section initially, before being deformed into a dovetail-shaped channel 203 in cross-section.

As shown in FIG. 13, the channel 203 may have an electrically insulating layer 209 therein. The electrically insulating layer 209 may be positioned between the heating element 205 and the body 201. The electrically insulating layer 209 may extend around less than the entire heating element 205 in cross-section.

Figure 14:
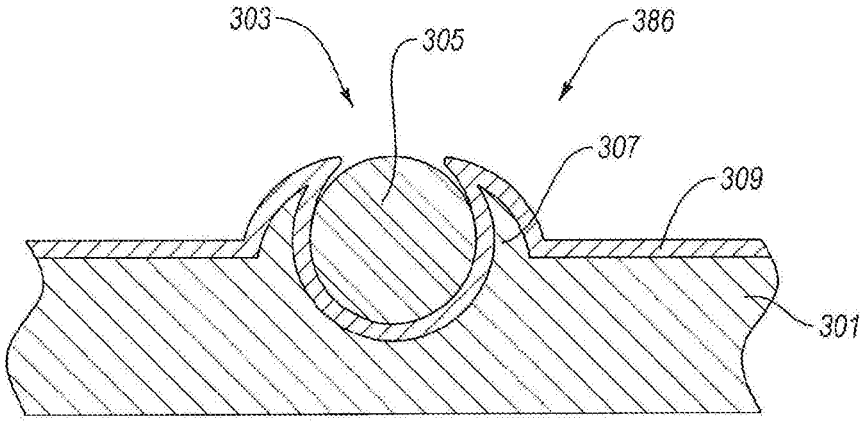
FIG. 14 shows a partial side cross-section of yet another embodiment of a heater, according to the present disclosure.

FIG. 14 illustrates a partial cross-sectional view of yet another embodiment of a heater 386 with an electrically insulating layer 309 extending over the surface of a body 301 of the heater 386, as well as a channel 303. For example, the body 301 may be an electrically conductive material, as described herein, that is anodized to provide an electrically insulating layer 309 (i.e., an oxide layer) bonded to the surface of the body 301. In some embodiments, part of the body 301 may be anodized. In other embodiments, the entire surface of the body 301 may be anodized, producing an electrically insulating layer 309 over the entire surface of the body 301. For example, the electrically insulating layer 309 may extend over the body 301, the channel 303, and the retention members 307.

Figure 15:
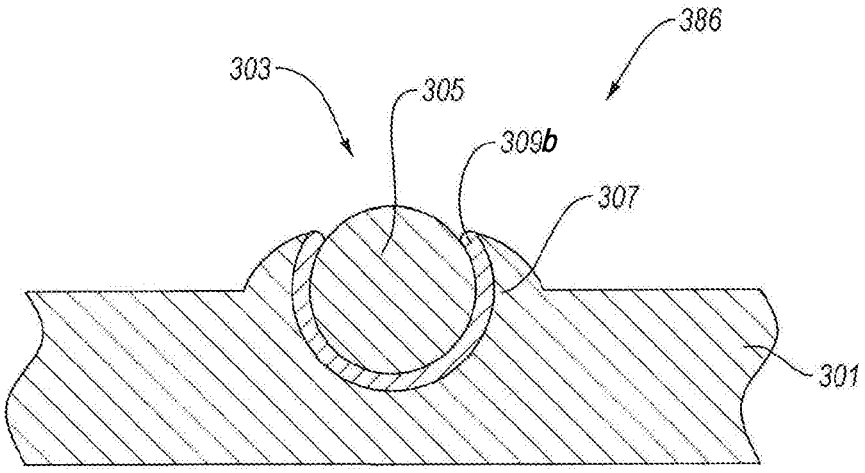
FIG. 15 shows a partial side cross-section of the embodiment of a heater of FIG. 14 with an electrically insulating layer over a part of the body, according to the present disclosure.

FIG. 15 illustrates the embodiment of a heater 386 of FIG. 14 with the electrically insulating layer **309*b* extending over only a portion of the body 301. For example, the electrically insulating layer 309*b* may cover the channel 303 only such that part of the retention members 307 are covered by the electrically insulating layer 309*b* and at least a portion of the retention members 307 are not covered by the electrically insulating layer 309*b*. In some embodiments, the electrically insulating layer 309*b* may be applied to or deposited on the channel 303 only. In other embodiments, such as in an anodized embodiment, the electrically insulating layer 309 may be initially applied to the body 301, the channel 303, and the retention members 307 (such as shown in FIG. 14) and the electrically insulating layer 309 may be removed from substantially all portions of the body 301 and at least a portion of the retention members 307. The electrically insulating layer 309*b* may be partially removed by laser etching, ion etching, chemical etching, mechanical removal, or combinations thereof. In at least one embodiment, the electrically insulating layer 309*b* may be partially removed with a $CO_2$ laser. Additionally, in at least one embodiment the electrically insulating layer 309** may be partially applied by sputtering, spraying, or other deposition methods known in the art.

Figure 16:
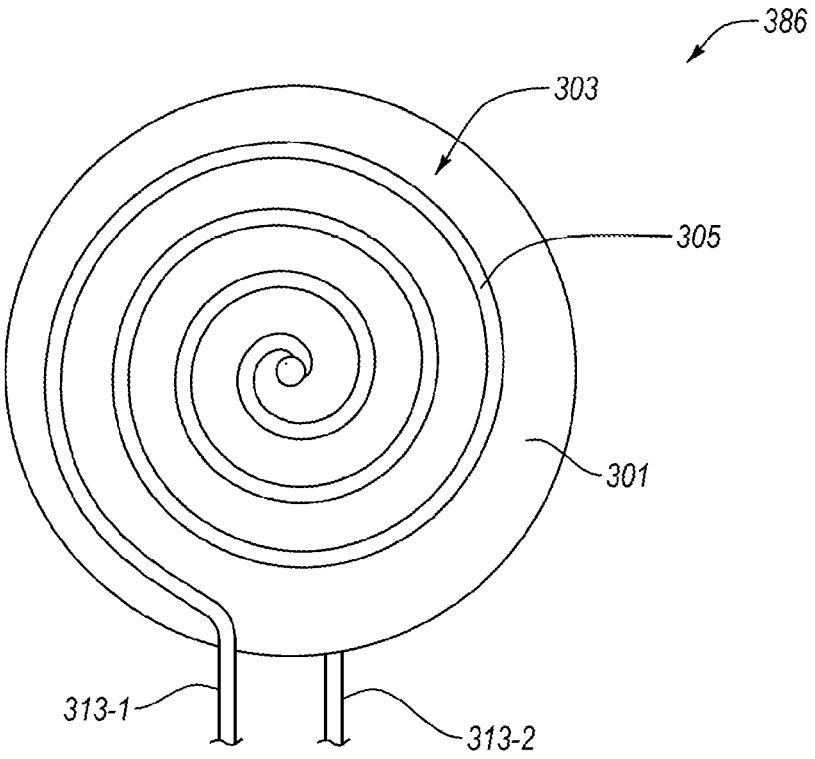
FIG. 16 shows a top view of the embodiment of a heater of FIG. 14, according to the present disclosure.

Various embodiments and features of the connection of the heating element to the body of the heater have been described in relation to FIG. 12 through FIG. 15. FIG. 16 illustrates a top view of the embodiment of a heater 386 of FIG. 15. The heater 386 has a substantially circular body 301. In other embodiments, the body 301 may also be rectangular, square, elliptical, triangular, other polygonal, irregular, or combinations thereof.

The channel 303 may be configured to provide connection of the heating element 305 distributed across the body 301. For example, the channel 303 shown in FIG. 16 is a spiral that evenly positions the heating element 305 across the circular body 301. In other examples, the channel 303 may have alternating, parallel passes to evenly distribute the heating element 305 across a rectangular body 301. The heating element 305 has terminals 313-1, 313-2 that may be connected to an energy source to heat the heating element 305. In the depicted embodiment, the first terminal 313-1 is located on a first side of the body 301 and the second terminal 313-2 is located on an opposing second side of the body 301. In other embodiments, the first terminal 313-1 may be located on the first side of the body 301 and the second terminal 313-2 may also be located on the first side of the body 301, such as terminals 413-1 and 413-2 in the embodiment shown in FIG. 17.

Figure 17:
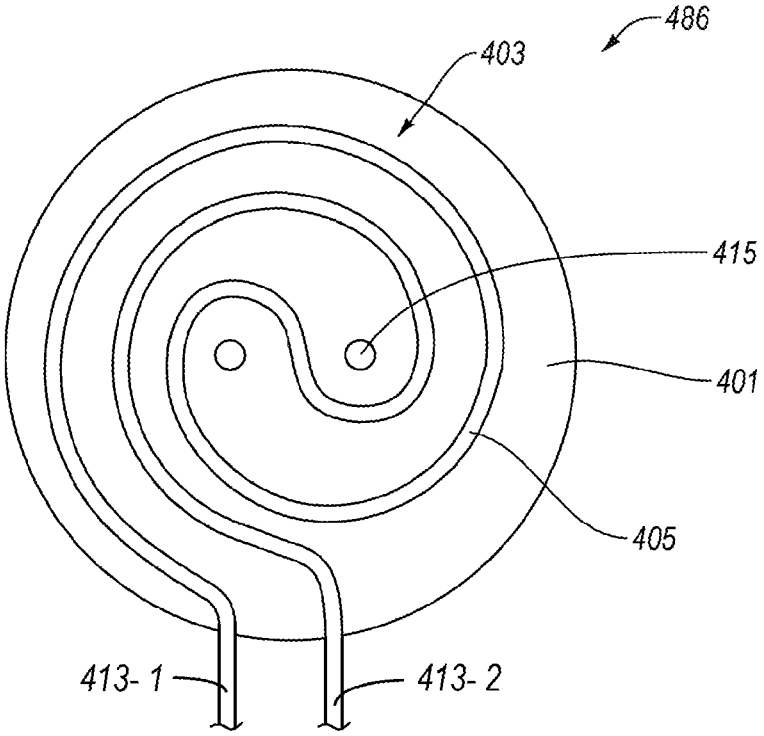
FIG. 17 shows a top view of another embodiment of a heater, according to the present disclosure.

FIG. 17 is a top view of another embodiment of a heater 486. The heater 486 includes a channel 403 laid out in concentric spirals on the body 401. The concentric spirals allow the channel 403 and heating element 405 to be distributed evenly about the surface of the body 401 and may aid in averaging out any variations in thermal efficiency of the heating element 405 along a length of the heating element 405. The concentric spirals also may join at or near the center of the body and/or the spirals. One or more thermal sensors 415, such as thermocouples, may be positioned at or near the center. In some embodiments, the one or more thermal sensors 415 may be secured or located on a surface of the body 401. In other embodiments, the one or more thermal sensors 415 may be positioned through the body 401. For example, the one or more thermal sensors 415 may be located in a bore that extends at least partially through the body.

Figure 24:
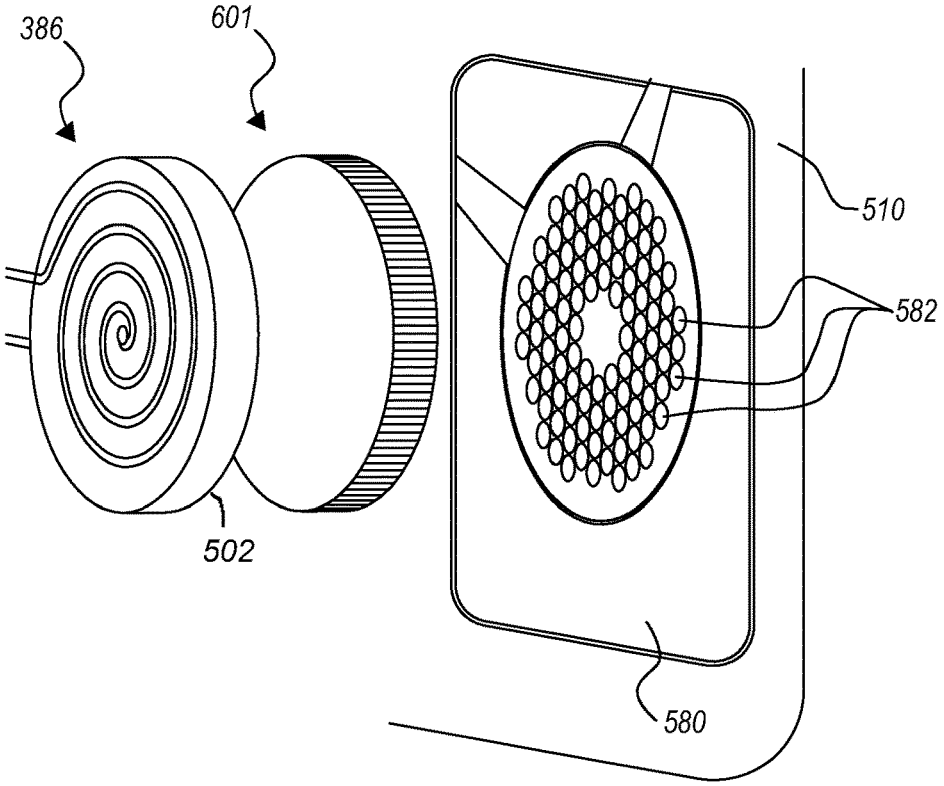
FIG. 24 is an exploded view of FIG. 23.

The one or more thermal sensors 415 may be positioned within the bore to monitor the temperature of the body 401 at a selected longitudinal depth of the body 401. The body 401 may have a thickness such that a thermal gradient may be established in the body 401 during heating and/or cooling. The one or more thermal sensors 415 may be located at different depths within the body 401 to monitor the gradient. In other embodiments, the one or more thermal sensors 415 may be positioned at or near the interface of interest. For example, the heater 486 may be oriented in the instrument 800 shown in FIG. 2 (at the location of heater 886, 887, 888, or combinations thereof) such that either the heating element 405 or the opposing side (e.g., opposing side 502 of heater 386 as shown in FIG. 24) of the body 401 is facing the blisters 522, 544, 546, 548, 564, and 566. The one or more thermal sensors 415 may be positioned such that the one or more thermal sensors 415 measure the temperature of the heater 486 at or adjacent to the blisters 522, 544, 546, 548, 564, and 566.

Figure 18:
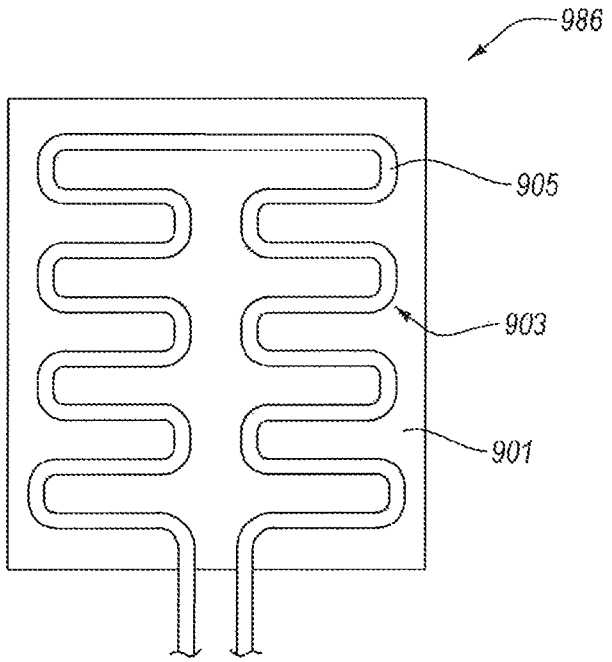
FIG. 18 shows a top view of yet another embodiment of a heater, according to the present disclosure.
Figure 19:
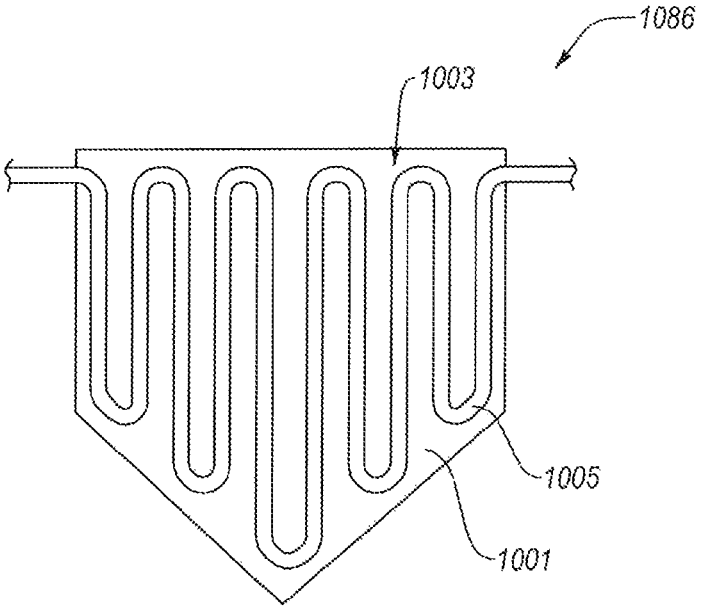
FIG. 19 shows a top view of a further embodiment of a heater, according to the present disclosure.

Another embodiment of a heater 986 is shown in FIG. 18. The heater 986 has a body 901 with a square shape. The channel 903 and the heating element 905 are positioned on the body 901 in alternating traces to conduct heat from the heating element 905 to the body 901 substantially evenly across the body 901. FIG. 19 shows another embodiment of a heater 1086 with a body 1001 that has an irregular polygonal shape. The channel 1003 and the heating element 1005 are positioned on the body 1001 in alternating traces to conduct heat from the heating element 1005 to the body 1001 substantially evenly across the body 1001. It should be appreciated that the illustrative examples provided in FIGS. 16-19 can incorporate any of the embodiments shown in FIGS. 12-15, the description associated therewith, or variations thereof.

Figure 20:
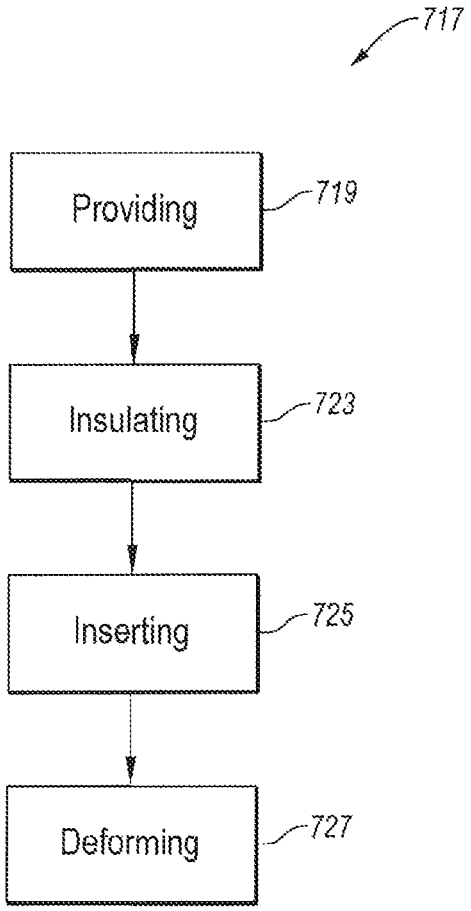
FIG. 20 is a flowchart illustrating an embodiment of a method of manufacturing a heater, according to the present disclosure.
Figure 21:
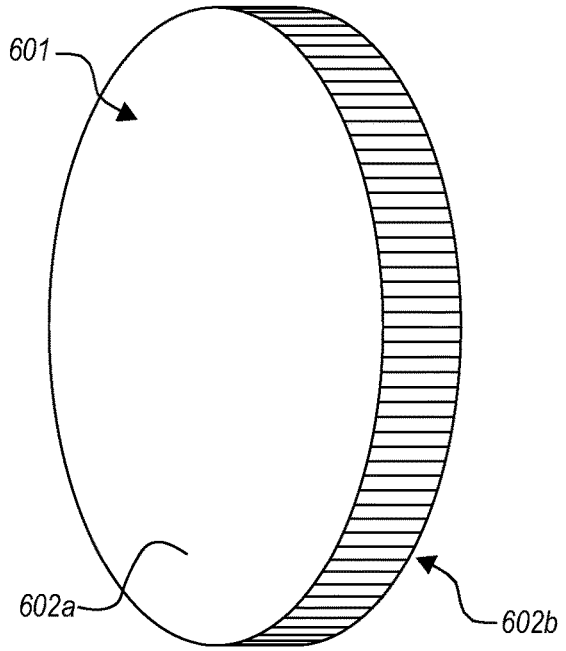
FIG. 21 is a perspective view of an embodiment of a heat transfer device.

The embodiments of heaters described herein and other heaters according to the present disclosure may be manufactured according a method 717 illustrated in FIG. 20. The method 717 includes providing 719 a body of a heater with a channel. In some embodiments, the channel may have one or more retention members, such as described in relation to FIG. 12. In other embodiments, the channel may be recessed into the body without retention members, such as described in relation to FIG. 13. In some embodiments, the channel may be formed by casting the channel and/or retention members in the body. In other embodiments, the channel may be formed by machining the channel and/or retention members in the body. In yet other embodiments, the channel may be formed by stamping or coining the channel and/or retention members in the body. In further embodiments, the channel may be formed by etching the channel and/or retention members in the body. For example, the channel and/or retention members may be chemically etched in the body. In other examples, the channel and/or retention members may be ion etched into the body with a broad beam or focused beam ion source. In yet other examples, the channel and/or retention members may be plasma etched into the body.

The method 717 further includes electrically insulating 723 the body against a heating element. The electrical insulation may be applied to the heating element, such as a polyimide coating described in relation to FIG. 12, or to the body, such as the anodize coating described in relation to FIG. 14 and FIG. 15. However, it is understood that in some embodiments it may be desirable to omit the insulating layer. The method 717 further includes inserting 725 the heating element into the channel of the body and deforming 727 at least a portion of the heater to mechanically retain the heating element in the channel. In some embodiments, deforming 727 at least a portion of the heater may include deforming one or more retention members, illustratively by bending or crimping the retention members. In other embodiments, deforming 727 at least a portion of the heater may include deforming part of the heating element.

Mechanically securing a heating element in a heater may allow for elimination of some or all of the adhesives in the heater, thereby reducing the thermal mass of the heater and increasing thermal conductivity between the heating element and a thermally conductive body, heat spreader, or similar (e.g., any of bodies 101, 201, 301, 401, 901, and/or 1001 as shown in FIGS. 12-19). Reducing the thermal mass and increasing thermal conductivity increases the heating and cooling rates of the heater, allowing more efficient and faster cycling in applications such as PCR and the PCR instrument described herein.

Figure 22:
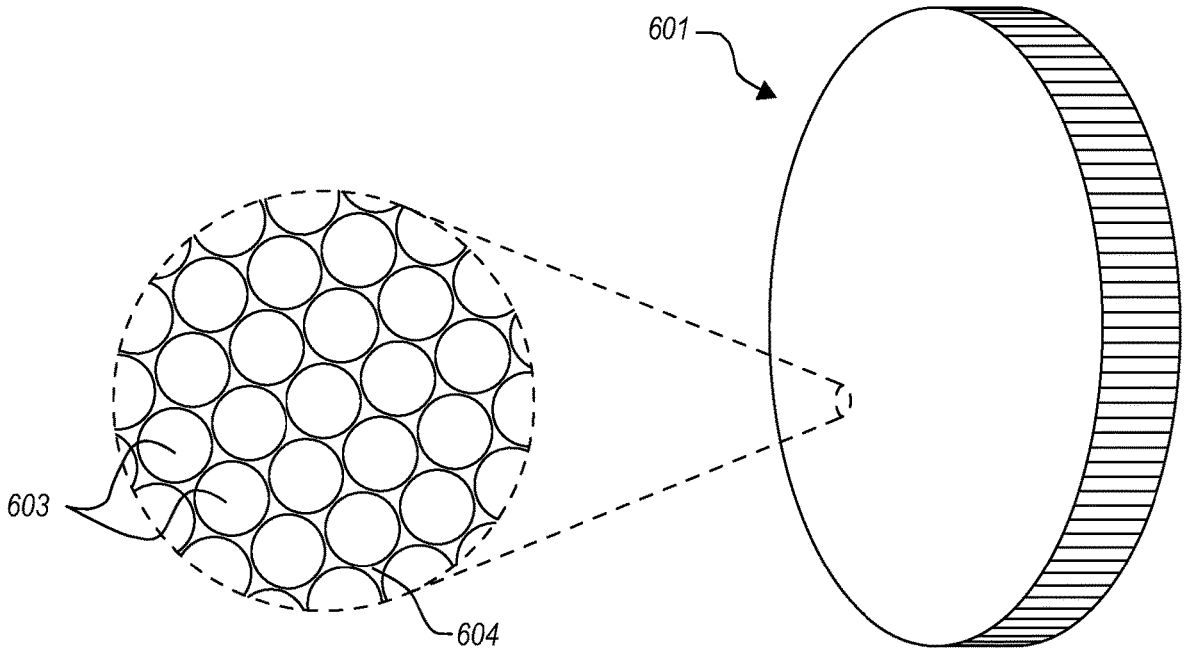
FIG. 22 is a perspective view of an embodiment of a heat transfer device made with carbon fibers, with an enlarged view of the top surface of the device shown.
Figure 23:
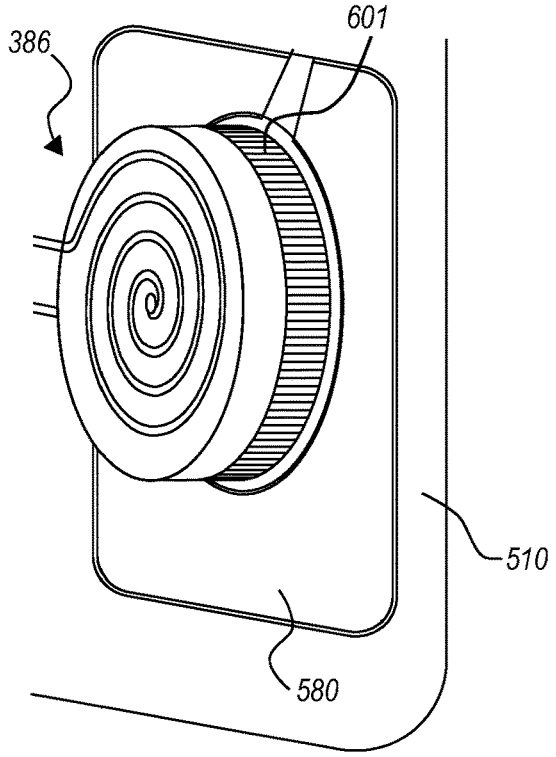
FIG. 23 is a perspective view of an embodiment of a heater together with an embodiment of a heat transfer device and sample vessel.
Figure 25:
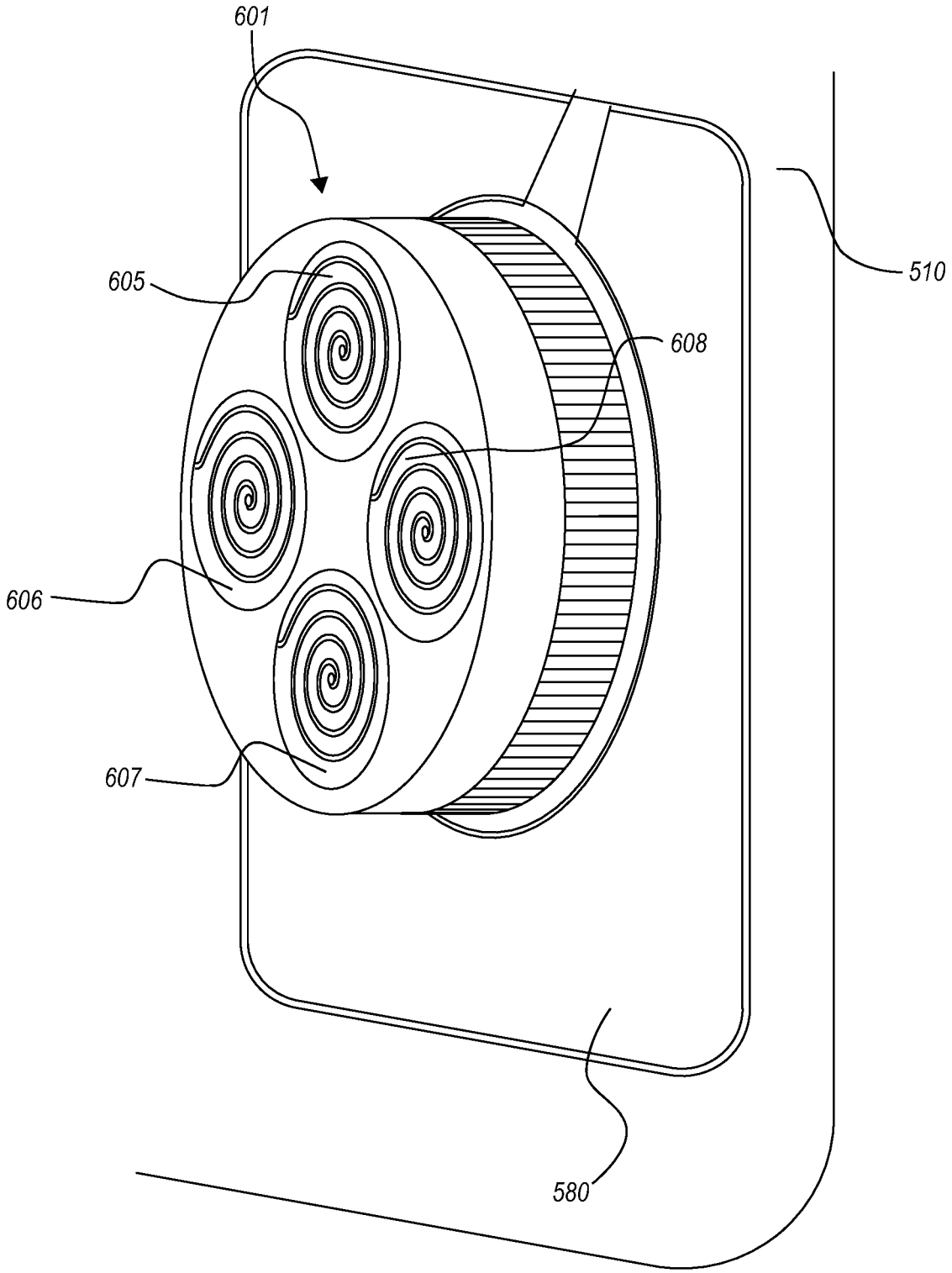
FIG. 25 is a perspective view of an embodiment of multiple heaters together with an embodiment of a heat transfer device and sample vessel.

FIGS. 21-25 illustrate an embodiment of an anisotropic heat transfer device 601, individually and in connection with the heater 386 and the pouch 510. As illustrated in FIGS. 23-25, the anisotropic heat transfer device 601 may be located between the heater 386 and the second stage reaction zone 580 where the sample fluid resides in the second stage wells 582 to facilitate heat transfer between the heater 386 and the sample fluid.

In this embodiment, the heat transfer device 601 is in the form of a disc or a cylinder with two opposing, cross-sectional circular faces 602*a*, 602*b*. The heat transfer device 601 may be formed of anisotropic fibers that are aligned axially normal to the cross-sectional faces and run from one opposing face to the other. In other embodiments, the heat transfer device may have any cross-sectional shape. The desired cross-sectional shape may depend on the shape of the heater or the area being heated.

The heat transfer device may make contact with, or may be in close proximity to, both the heater/cooler and a target, so as to transfer heat to and from the target. In this embodiment, the target includes the second stage wells 582 within the second stage reaction zone 580. Other targets may include various blisters 522, 546, 548, 566 and channels 552, 565, of the pouch, or any surface in contact with or in close proximity to the heat transfer device where temperature regulation is desired. This heat transfer occurs anisotropically, in a direction perpendicular to the top face 602*a* of the heat transfer device 601. That is, heat is conducted readily and efficiently through faces 602*a* and 602*b* of the heat transfer device 601, but heat is conducted very poorly laterally to the edges of the heat transfer device 601.

In one embodiment of the heat transfer device, shown in FIG. 22, the anisotropic heat transfer is accomplished using carbon fibers. Carbon fibers are one example material for the heat transfer device 601 because of the anisotropic properties of carbon fibers. In other embodiments, other materials such as graphite fibers or pyrolytic graphite fibers may be used as well. Carbon fiber cross sections 603 are illustrated from a top view of the heat transfer device 601, with resin 604 filling the spaces in between the carbon fibers 603. The carbon fibers are aligned perpendicular to the top face 602*a* of the heat transfer device 601 and normal to the transverse plane of both the heater 386 and the second stage reaction zone 510.

Resin 604, such as an epoxy resin, is one example of a retaining mechanism that can be used to hold the fibers 603 together. In one embodiment, the heat transfer device can be formed by lining up carbon fibers so the axes thereof are generally parallel and infusing the fibers with resin. Lining up the fibers and infusing them with resin may be done in a number of ways, including but not limited to pultruding unidirectional tow, stacking and pressing pre-preg lamina, and clamping dry tow and infusing the fibers with resin using a resin transfer molding method. "Pre-preg" is a term for "pre-impregnated" composite fibers where a matrix material, such as epoxy, is already present. The fibers are often unidirectional, having a straight, constant cross-section and the matrix is used to bond them together and to other components during manufacture. Pre-preg is available in a variety of layups and the fiber composition (e.g., graphene or carbon nanotubes may be included along with typical carbon fiber) may be varied according to manufacturer specifications.

Another method of aligning the fibers may be laying fibers that have been cut to the same length in a vat and applying a charge to the bottom surface of the vat. Applying a charge to the bottom surface of the vat can create an opposite charge at the top surface of the vat, which causes the fibers to stand on end. The standing fibers can then be clamped together and infused with resin illustratively using a vacuum bagging method.

After the fibers are infused with resin, so that the resin fills the interstices between the fibers, the resin may be cured and the resulting product can be cut into wafers. Such wafers may have a round, thin shape as shown in FIGS. 21-25. The surfaces of the wafer may then be polished smooth. Other thermoset resins and thermoplastic polymers such as polyester resin, vinyl ester resin, phenolic, urethane, and other resins known in the art, can be used to hold the carbon fibers together. In addition to or as an alternative to resins or other adhesives, retaining mechanisms may include structural mechanisms, such as a ring surrounding the outer circumference of the heat transfer device, may be employed to hold the fibers together.

With the carbon fibers axially aligned between the faces 602*a*, 602*b*, heat is transferred between the faces 602*a*, 602*b* with minimal radial heat spread. Illustratively, the axial thermal conductivity of carbon fiber is up to four orders of magnitude greater than its radial conductivity. This results in highly efficient heat transfer in the direction of the fibers with minimal radial heat spread or loss out of the heat transfer device 601.

Because of the anisotropic property of the fibers, the heat being transferred by individual fibers tends not to be affected by or affect neighboring fibers. As a result, the heat transfer device may be able to transfer heat from one or more heaters (e.g., from more than one temperature zone), simultaneously, without transferring heat through the heat transfer device from one heated cross-sectional area to another. FIG. 25 illustrates an embodiment with multiple heaters 605, 606, 607, 608 transferring heat independently through the heat transfer device 601 to the second stage reaction zone 580. Different second stage sample wells 582, shown in FIG. 24, can be heated to different temperatures independently in this way.

This illustrative embodiment of the heat transfer device, when made out of commercially available carbon tow, achieves a thermal conductivity in the range of $$300-600\ \frac{\mathrm{W}}{\mathrm{m}\cdot\mathrm{K}}\ \text{(Watts per meter Kelvin).}$$

This embodiment of the heat transfer device, when made out of commercially available graphite fibers, can achieve a thermal conductivity in the range of about $$300-900\ \frac{\mathrm{W}}{\mathrm{m}\cdot\mathrm{K}}.$$

A higher thermal conductivity can be achieved using higher strength carbon fibers and increasing the carbon fiber 603 to resin 604 ratio. Carbon fibers have been shown to axially conduct heat with a thermal conductivity of up to $$1200\ \frac{\mathrm{W}}{\mathrm{m}\cdot\mathrm{K}},$$

with a theoretical maximum thermal conductivity of $$1500\ \frac{\mathrm{W}}{\mathrm{m}\cdot\mathrm{K}}.$$

Carbon nanotubes, which can, for example, be mixed with conventional carbon or graphite fibers to achieve even higher thermal conductivity, have a theoretical maximum thermal conductivity of about $$6600\ \frac{\mathrm{W}}{\mathrm{m}\cdot\mathrm{K}}.$$

In comparison, the thermal conductivity of common conductors such as aluminum and copper is approximately $$200\ \frac{\mathrm{W}}{\mathrm{m}\cdot\mathrm{K}}$$

and $$400\ \frac{W}{\mathrm{m}\cdot\mathrm{K}},$$

respectively.

In addition, the specific heat capacity of graphite is $$0.72\ \frac{\mathrm{J}}{\mathrm{g}\cdot{}^{\circ}\,\mathrm{C.}}\ \text{(Joules per gram Celsius)}$$

compared to $$0.90\ \frac{\mathrm{J}}{\mathrm{g}\cdot{}^{\circ}\,\mathrm{C.}}.$$

for aluminum. In one embodiment of the heat transfer device, the fibers have a specific heat capacity between 0.6 and $$0.8\ \frac{J}{g\cdot{}^\circ C.},$$

or below $$0.8\ \frac{J}{g\cdot{}^\circ C.}.$$

The density of these fibers is typically about 2.2 g/cm$^3$ compared to 2.7 g/cm$^3$ for aluminum and 8.9 g/cm$^3$ for copper, resulting in a much lower thermal mass. This low thermal mass requires low amounts of energy to change the temperature of the carbon fibers, resulting in efficient thermo-cycling of the sample in the second stage wells 582 and reduced PCR run time.

FIG. 23 is a perspective view of an embodiment of the heater 386, the heat transfer device 601, and the second stage reaction zone 580, which resides in the pouch 510. In this embodiment, the heat transfer device 601 remains stationary in relation to the second stage reaction zone 580, while the heater 386 may move, making contact with the heat transfer device 601, but not the second stage reaction zone 580. Such movement could occur, for example, in a multi-heater embodiment shown in FIG. 9 and described above.

Movement of the heater 386 in direct contact with the second stage wells 582 can cause the sample fluid to leak back out of the wells, leading to unwanted mixing and sample contamination. The embodiment shown in FIG. 23 reduces or eliminates contact and friction between the pouch 510 and the heater 386, protecting the pouch 510 from wear and leaving the fluid inside the second stage wells 582 undisturbed.

Figure 26:
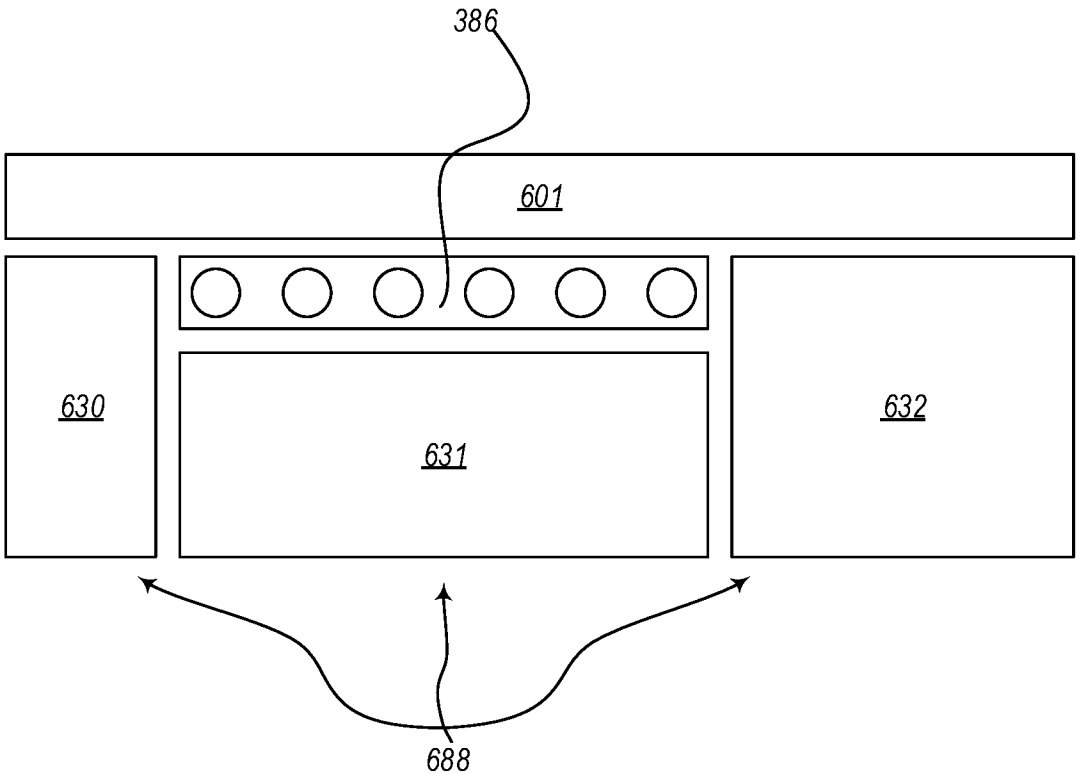
FIG. 26 is an elevation view of an embodiment having multiple heaters associated with a heat transfer device.

Referring now to FIG. 26, illustrated is a heat assembly 688 having a plurality of heaters, particularly heaters 386, 630, 631, and 632, and heat transfer device 601, as described above. Heaters 630, 631, and 632 can be any type of heater described above, such as a Peltier device, block heater, resistance heater, electromagnetic heater, or thin film heater. In an embodiment, heaters 631 and 632 are Peltier devices, and as illustrated, the Peltier device 631 is in thermal communication with—and in some embodiments coupled to—heater 386. It has been unexpectedly shown that combining a Peltier device with a resistive heating element can create a more efficient heater than either heater alone, and in some embodiments, can allow the temperature to be modulated more accurately and quickly. Further, the energy requirement for both the Peltier device and the resistive heating element may be reduced when combined. For example, the total energy requirement for heating the combined Peltier device and resistive heater to a given temperature (e.g., a denaturation temperature) is less than the energy requirement for heating a lone Peltier device to the same given temperature and is also less than the energy requirement for heating a lone resistive heater to the same given temperature.

The heat transfer device 601 makes contact with, or is in close proximity to, both a target (e.g., a sample or container holding a sample) and one or more heaters 630, 631/386, 632, so as to transfer heat to and from the target. In such an embodiment, the target can include the second stage wells 582 within the second stage reaction zone 580. Other targets can include various blisters 522, 546, 548, 566 and channels 552, 565, of the pouch, or any surface in contact with or in close proximity to the heat transfer device where temperature regulation is desired. This heat transfer occurs anisotropically, in a direction perpendicular to a target interaction surface of the heat transfer device 601 and/or parallel to the axially-aligned anisotropic fibers of the heat transfer device 601. That is, heat is conducted readily and efficiently from the heaters 630, 631/386, 632 through the heat transfer device 601, while heat is conducted poorly in a lateral direction (i.e., to the edges of the heat transfer device 601 or in a direction transverse to the axially-aligned anisotropic fibers).

Although FIG. 26 depicts the heaters aligned serially or adjacent to one another, in some embodiments, the heaters 630, 631/386, and 632 can be part of a multi-heater assembly disposed on a circular mount, similar to that depicted in FIG. 9. The heaters can individually be set at a static temperature, and in such an embodiment, the heaters can be rotated and/or selectively positioned such that only one heater is positioned over a target at a given time. In an embodiment, the heat transfer device is stationary while the individual heaters are rotated. Alternatively, each heater is associated with an individual heat transfer device that rotates with the heater.

It should be appreciated that the heater assembly 688 of FIG. 26 can include any number or types of heaters and should not be limited to the specific orientation and type of heater illustrated thereby. For example, a heater assembly can include two Peltier devices that are each in thermal communication with a separate resistive heat element and individual heat transfer devices. A first Peltier device and resistive heat element can be set at a denaturation temperature of, illustratively, 94° C. The second Peltier device and resistive heat element can be set at an annealing temperature of, illustratively, 60° C. The target can be selectively moved between the two temperatures, or alternatively, the heaters can be selectively moved over the target, as described above.

In some embodiments, the heaters—whether in combination with or separate from a heat transfer device—can be used for one or more additional or alternative purposes than that described above. For example, a heater can be positioned and heated to seal a channel or hole. Illustratively, a heater can be positioned proximate to and/or in contact with any of channels 538, 543, 552, 553, 562, 565, or similar of pouch 510 illustrated in FIG. 1. The heater can be, illustratively, at a temperature sufficient to thermally couple the opposing sides of the channel, thereby sealing the channel. It should be appreciated that the heater can be pre-heated to a thermal coupling temperature before or after the heater is initially contacted or positioned proximate to the target.

While the present disclosure describes the heater devices, systems, and methods in relation to PCR, biological, and chemical analysis, it should be understood that a heater according to the present disclosure may be used in other applications outside of PCR and/or laboratory analysis in any application where improved thermal cycling rates are desirable.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for performing polymerase chain reaction (PCR), the system comprising:

a support member configured to receive a sample vessel having a sample therein;

a heater assembly associated with the support member and positioned to affect a temperature of the sample vessel, the heater assembly comprising a first heating member and a second heating member spaced apart from the first heating member, the first heating member and the second heating member each comprising a resistive heater; and a heat transfer device disposed between the heater assembly and the sample vessel, the heat transfer device comprising anisotropic fibers axially aligned parallel to one another and positioned to conduct heat from the heater assembly toward the sample vessel in the axial direction of the anisotropic fibers, the anisotropic fibers each being configured to conduct heat independently of other anisotropic fibers in the axial direction and to retard heat transfer laterally between the anisotropic fibers, wherein the heater assembly is moveable relative to the support member to selectively align the first heating member or the second heating member with the sample vessel to selectively transfer heat from the first heating member or the second heating member to the sample vessel through the heat transfer device, wherein the heater assembly further comprises a Peltier device in thermal communication with each resistive heater, the resistive heaters each being disposed between the respective Peltier device and the heat transfer device, and wherein the first heating member and the second heating member are each maintained at a constant temperature, the first heating member being maintained at a different temperature than the second heating member.

2. The system as in claim 1, wherein each resistive heater comprises:

a body defining one or more channels;

a resistive heating element positioned in the one or more channels; and an electrically insulating layer positioned at least between the resistive heating element and the body, wherein the resistive heating element is mechanically interlocked within the channel.

3. The system as in claim 2, further comprising one or more retention members disposed adjacent to the one or more channels and mechanically interlocking the resistive heating element within the channel, the one or more retention members being deformable between an open position and a closed position, wherein in the closed position, the one or more retention members extend at least partially around the resistive heating element.

4. The system as in claim 3, wherein the one or more channels surround at least 50% of the resistive heating element, as defined by a transverse cross-section of the at least one heater.

5. The system as in claim 2, wherein the body further comprises:

a first surface, wherein the first surface defines the one or more channels; and a second surface opposite the first surface, the second surface being oriented toward the sample vessel.

6. The system as in claim 5, further comprising a thermal sensor positioned at the second surface of the body.

7. The system as in claim 1, wherein the first heating member is set at a denaturation temperature and the second heating member is set at an annealing temperature, the denaturation temperature being greater than the annealing temperature.

8. The system as in claim 7, wherein the heater assembly further comprises a third heating member spaced apart from the first heating member and the second heating member and maintained at an extension temperature that is greater than the annealing temperature and less than the denaturation temperature, the third heating member comprising a resistive heater, wherein the heater assembly is moveable relative to the support member to selectively align the third heating member with the sample vessel to selectively transfer heat from the third heating member to the sample vessel through the heat transfer device.

9. The system as in claim 1, wherein the heater assembly further comprises a mount, the first heating member and the second heating member being disposed on or in the mount, the mount being configured to selectively move the first heating member and the second heating member relative to the sample.

10. The system as in claim 9, wherein the mount is circular or polygonal.

11. A system for heating, comprising:

a heating target area;

a heater assembly comprising a plurality of heating members, each of the plurality of heating members comprising a resistive heater, wherein each of the heating members is heated to a different temperature and maintained at the different temperature; and a heat transfer device disposed between the heater assembly and the heating target area and positioned adjacent to the heater assembly, such that the plurality of heating members are in thermal communication with the heat transfer device, the heat transfer device comprising:

a plurality of anisotropic fibers axially aligned parallel to one another and configured to conduct heat in an axial direction of the anisotropic fibers from the heater assembly to the heating target area opposite the heat transfer device from the heater assembly, the anisotropic fibers each being configured to conduct heat independently of other anisotropic fibers in the axial direction and to retard heat transfer laterally between the anisotropic fibers; and a retaining mechanism configured to hold the anisotropic fibers together, wherein the heating members of the heater assembly are spaced apart one from another and configured to transfer heat through the heat transfer device to the heating target area, wherein the plurality of heating members are simultaneously in thermal communication with the heat transfer device, and wherein the heater assembly is selectively movable to cause the plurality of heating members to be alternatingly positioned so as to be aligned with different parts of the heating target area, respectively, within thermal communication with the heat transfer device.

12. The system of claim 11, wherein a first heating member of the heater assembly is set at a denaturation temperature and a second heating member of the heater assembly is set at an annealing temperature, wherein the denaturation temperature is greater than the annealing temperature.

13. The system of claim 12, wherein the heater assembly further comprises a third heating member spaced apart from the first heating member and the second heating member and maintained at an extension temperature that is greater than the annealing temperature and less than the denaturation temperature, the third heating member comprising a resistive heater, wherein the third heating member is configured to transfer heat through different anisotropic fibers of the heat transfer device than the first heating member and the second heating member and to a different part of the heating target area than the first heating member and the second heating member.

14. A system, comprising:

a heating target area;

a heater assembly comprising a mount and a plurality of heating members disposed on or in the mount and spaced apart one from another, each of the plurality of heating members comprising a resistive heater, wherein each of the heating members is heated to a different temperature and maintained at said different temperature, the mount being configured to selectively move the heating members relative to the heating target area to selectively align the heating members, respectively, with the heating target area; and a heat transfer device disposed between the heater assembly and the heating target area and positioned adjacent to the heater assembly such that the heater assembly is in thermal communication with the heat transfer device, the heat transfer device comprising a plurality of anisotropic fibers axially aligned parallel to one another and configured to conduct heat in an axial direction of the anisotropic fibers from the heater assembly to the heating target area opposite the heat transfer device from the heater assembly, the anisotropic fibers each being configured to conduct heat independently of other anisotropic fibers in the axial direction and to retard heat transfer laterally between the anisotropic fibers, wherein the heater assembly further comprises a Peltier device in thermal communication with each resistive heater, the resistive heaters each being disposed between the respective Peltier device and the heat transfer device.

* * * * *